US011767144B2

(12) United States Patent
Bressan et al.

(10) Patent No.: US 11,767,144 B2
(45) Date of Patent: Sep. 26, 2023

(54) CONTAINER AND PROCESS OF MAKING THE SAME

(71) Applicant: I.G.B. S.r.l., Milan (IT)

(72) Inventors: Alessio Bressan, Varese (IT); Michel Bressan, Induno Olona (IT); Alberto Gandolla, Induno Olona (IT)

(73) Assignee: I.G.B. S.r.l., Milan (IT)

( * ) Notice: Subject to any disclaimer, the term of this patent is extended or adjusted under 35 U.S.C. 154(b) by 0 days.

(21) Appl. No.: 17/530,904

(22) Filed: Nov. 19, 2021

(65) Prior Publication Data

US 2022/0153510 A1 May 19, 2022

(30) Foreign Application Priority Data

Nov. 19, 2020 (IT) ..... 102020000027753
Nov. 19, 2020 (IT) ..... 102020000027756

(51) Int. Cl.
*B65D 5/42* (2006.01)
*B65D 5/20* (2006.01)

(52) U.S. Cl.
CPC ..... *B65D 5/4295* (2013.01); *B65D 5/2057* (2013.01); *B65D 2401/60* (2020.05); *B65D 2585/366* (2013.01)

(58) Field of Classification Search
CPC ..... B65D 5/541; B65D 5/5455; B65D 5/546; B65D 5/0254; B65D 5/106;
(Continued)

(56) References Cited

U.S. PATENT DOCUMENTS 1,341,429 A * 5/1920 Lewis ..... B65D 5/325 229/160
2,026,417 A * 12/1935 Conway ..... B65D 5/4295 119/490
(Continued)

FOREIGN PATENT DOCUMENTS

BE 410524 A 8/1935
DE 8324259 U1 1/1984
(Continued)

OTHER PUBLICATIONS

Ministero Dello Sviluppo Economico, Rapporto di Ricerca (Extended Search Report) for Italian Patent Application No. IT202000027753, dated Jul. 7, 2021, Munich, Germany.
(Continued)

*Primary Examiner* — Nathan J Newhouse
*Assistant Examiner* — Phillip D Schmidt

(57) ABSTRACT

The present invention regards a container comprising a support having a base, a lateral wall and an abutment flap emerging from the lateral wall. The container comprises a closure system movable between a closed condition and open condition, a first coupling portion carried by the closure system and a second coupling portion defined on the abutment flap. The first coupling portion is movable between a first operating position in which it is disengaged from the second coupling portion and a second operating position in which it is engaged with said second coupling portion. The first coupling portion comprises a central body from which a tab emerges that is engageable with the second coupling portion; the first coupling portion defines a removable portion configured for being separated from the closure system following a first opening of the container following an engagement between said first and second coupling portions.

15 Claims, 12 Drawing Sheets

(58) Field of Classification Search
CPC ..... B65D 2401/15; B65D 2401/60; B65D 2585/366; B65D 5/22; B65D 2401/00; B65D 5/2057; B65D 5/247
USPC ..... 229/102, 150, 222, 906, 149, 155; 206/807
See application file for complete search history.

(56) References Cited

U.S. PATENT DOCUMENTS 2,349,707 A * 5/1944 Esposito ..... B65D 5/106 229/155
2,698,125 A * 12/1954 Vizcarrondo ..... B65D 5/2057 229/117.14
3,214,855 A * 11/1965 Winkler ..... B65D 5/30 40/788
3,368,735 A * 2/1968 Levi ..... B65D 5/0245 206/424
3,541,052 A * 11/1970 Kirk ..... B65D 85/04 229/160
4,830,270 A * 5/1989 Holmes ..... B65D 5/0254 229/102
5,211,329 A * 5/1993 Patton ..... B65D 5/2033 229/125
5,240,176 A * 8/1993 Akers ..... B65D 5/566 220/908
5,328,080 A * 7/1994 Holley, Jr. ..... B65D 5/4279 206/140
5,950,912 A 9/1999 Economopoulos
10,633,140 B1 * 4/2020 Vergara ..... B65D 5/4266
2007/0170234 A1 * 7/2007 Cargile, Jr. ..... B65D 71/36 229/157
2011/0180537 A1 * 7/2011 Zimmermann ..... B65D 5/0254 220/257.2
2015/0251797 A1 * 9/2015 Carman ..... B65D 5/304 229/148
2019/0344927 A1 * 11/2019 Ozgercel ..... B65D 5/22

FOREIGN PATENT DOCUMENTS

DE 20300032 U1 4/2003
DE 202009003994 U1 6/2009
EP 3388353 A1 10/2018
GB 817223 A 7/1959
WO 2016063249 A1 4/2016

OTHER PUBLICATIONS

Ministero Dello Sviluppo Economico, Rapporto di Ricerca (Extended Search Report) for Italian Patent Application No. IT202000027756, dated Jul. 8, 2021, Munich, Germany.

* cited by examiner

CONTAINER AND PROCESS OF MAKING THE SAME

CROSS-REFERENCE TO RELATED APPLICATIONS

This application claims priority under 37 CFR 1.55 to Italian Patent Application No. 102020000027753 filed Nov. 19, 2020, and Italian Patent Application No. 102020000027756 filed Nov. 19, 2020. Both of said applications are incorporated by reference in their entirety as if fully set forth herein.

DESCRIPTION

Field of the Finding

The object of the present invention is a container for housing products, for example of food type. In particular, the container, object of the present invention, can be of the type to give evidence of tampering and be applied in the field of packaging food products, e.g. for pizzas, in order to ensure the supply of intact products, which are not all altered. The object of the present invention is also a process for attaining said container as well as a method for closing the same.

State of the Art

As is known, containers lacking tampering-evidence mechanisms are available on the market. For example, the patent application No. U.S. Pat. No. 5,240,176A shows a container for transporting trash having a locking system adapted to prevent the opening of the container while the patent application No. DE 20 2009 003994 U1 shows a container for pizza, it too lacking a tampering-evidence mechanism.

The containers today attained with tampering-evidence mechanisms are mainly used in the pharmaceutical sector in order to indicate the danger of a possible tampering or substitution of the product, hence ensuring product integrity for the consumer. Nevertheless, it is indicated that such containers have a structurally complex closure mechanism, hard to reinforce in brief time periods.

One type of tamper-evident container is described in the patent application No. BE410524A; such container comprises a store reclosable following the engagement between a first coupling portion carried by a closure system and a second coupling portion carried by the store itself. The first coupling portion has two foldable tabs configured for being engaged within a second coupling portion, while the latter is defined by a "V" folded tongue having a pocket adapted to receive the first coupling portion. The tabs are then configured for being inserted in the pocket and constrained to the second coupling portion: following a first open condition of the container, the tabs are configured for being detached from the closure system.

The Applicant has detected that such container has important limitations. In fact it should be observed that such container does not allow giving clear evidence of tampering in the case that the container has been previously opened. In fact, the user perceives the integrity of the container only based on the perception of the resistance exerted by the first coupling portion on the second coupling portion, without having visual evidence of tampering. Furthermore, such container attains a complex engagement between the first and second coupling portions, which cannot be executed in an automated manner, nor in a quick manner by an operator.

A second example of a tamper-evident container is described in the patent application No. US 2011/180537 A1. Such container comprises a store reclosable following the engagement between a first coupling portion carried by a closure system and a second coupling portion carried by the store. The first coupling portion comprises a tongue engaged with the closure system by means of a weakening portion and configured for being engaged within a single opening made on a panel carried by the store. In particular, the opening of the second coupling portion is entirely counter-shaped with respect to the first coupling portion and is configured for being aligned with the latter, in a manner such to allow the insertion thereof and define a closed condition of the container. Following the opening of the container, the first coupling portion is thus configured for being separated from the closure system, giving evidence of a first opening of the container.

The Applicant has detected that the container described in the United States patent application No. US 2011/180537 A does not allow defining an effective closure, capable of giving correct evidence of tampering of the container. Indeed, the Applicant has detected that the first coupling portion is easily extractable from the opening made on the panel engaged with the store without said first coupling portion being separated from the closure system.

Even if the above-described known containers are used today, the Applicant has detected that such containers are not free of limitations and drawbacks, and therefore can be improved with regard to several aspects.

OBJECT OF THE FINDING

Object of the present invention is therefore that of substantially resolving at least one of the drawbacks and/or limitations of the preceding solutions.

A first objective of the present invention is to provide a container which can effectively give evidence of tampering following a first opening attempt of the same. A further object of the present invention is that of providing a tamper-evident container that can be easily reinforced, both in an automated manner and by an authorized operator. Another object of the present invention is to provide a container that is simple and quick to manufacture, which allows minimizing the consumption of material and consequently the costs of production and transport. A further object of the present invention is to provide a container that is flexible in use which can be effectively employed on different types of containers of sheet material. Another object of the present invention is to provide a container capable of preventing the contact between one or more products housed in the container itself in the event in which the latter is closed by a user.

These objects and still others, which will be clearer from the following description, are substantially achieved by a container, a process for making the same and a method for closing the container in accordance with that expressed in one or more of the enclosed claims and/or of the following aspects.

SUMMARY

In a first aspect, a container (1) is provided for housing at least one product, e.g. of food type, said container (1) comprising:

- a support (2) defining an internal volume (3) configured for housing at least one product, said support (2) comprising:

at least one base (2*a*), at least one lateral wall (4) emerging from the base (2*a*) and delimiting, in cooperation with said base (2*a*), the internal volume (3), in which said at least one lateral wall (4) defines, opposite the base (2*a*), a free edge (6), at least one abutment flap (2*c*) emerging from at least one section of the free edge (6) and at least partly facing the base (2*a*), in which said at least one abutment flap (2*c*) at least partly delimits a passage opening (5) configured for placing in communication the internal volume (3) with the external environment, a closure system (7) movable with respect to the support (2) at least between:

a closed condition of the container in which the closure system (7) is configured for preventing the communication between the internal volume (3) of the support (2) and the external environment, and an open condition of the container in which the closure system (7) is configured for allowing the communication between the internal volume (3) and the external environment.

In one aspect according to the preceding aspect the closure system, in the closed condition, is at least partly abutted against the abutment flap (2*c*). In one aspect according to any one of the preceding aspects the closure system (7), in the open condition of the container is at least partly spaced from the abutment flap (2*c*). In one aspect according to any one of the preceding aspects the container is for housing one or more pizzas.

In one aspect according to any one of the preceding aspects the container comprises:

at least one first coupling portion (12) carried by the closure system (7), at least one second coupling portion (13) defined on the at least one abutment flap (2*c*).

In one aspect according to any one of the preceding aspects the second coupling portion (13) comprises at least one through pocket (13*a*) at least partly delimited by at least one undercut portion (13*b*).

In one aspect according to any one of the preceding aspects the first coupling portion (12), at least during a first closed condition of the container, is movable at least between:

a first operating position in which the first coupling portion (12) is disengaged from the second coupling portion (13), a second operating position in which at least part of the first coupling portion (12) passes through the through pocket (13*a*) and is arranged in the internal volume (3), engaging the undercut portion (13*b*).

In one aspect according to the preceding aspect the first coupling portion (12), in the first operating position, is at least partly facing the through pocket (13*a*) of the second coupling portion (13).

In one aspect according to any one of the preceding aspects the first and second coupling portions (12, 13), in the second operating position of the first coupling portion (12), are configured for defining a locking condition.

In one aspect according to any one of the preceding aspects at least part of the first coupling portion (12) defines a removable portion configured for being separated from the closure system (7) during a first open condition of the container, following the locking condition, in order to provide evidence of a tampering of the container (1).

In one aspect according to any one of the preceding aspects the first coupling portion (12) comprises:

at least one central body (12*a*), at least one tab (12*b*) emerging from the central body (12*a*).

In one aspect according to the preceding aspect the at least one tab (12*b*), at least in the first operating position of the first coupling portion (12), is at least partly facing the undercut portion (13*b*) of the second coupling portion (13). In one aspect according to any one of the preceding aspects the at least one tab (12*b*), at least during the passage of the first coupling portion (12) from the first to the second operating position, is configured for being folded with respect to the central body (12*a*) in order to allow the passage of the at least one tab (12*b*) itself and of at least one part of the central body (12*a*) through the through pocket (13*a*). In one aspect according to any one of the preceding aspects the at least one tab (12*b*), in the second operating position of the first coupling portion (12), is stably engaged with the undercut portion (13*b*) defining the locking condition.

In one aspect according to any one of the preceding aspects the support (2) is made of sheet material, optionally paper. In one aspect according to any one of the preceding aspects the closure system (7) is made of sheet material, optionally paper. In one aspect according to any one of the preceding aspects the first coupling portion (12) comprises a tongue of sheet material, optionally paper.

In one aspect according to any one of the preceding aspects the central body (12*a*) of the first coupling portion (12) has a size smaller than a passage area of the through pocket (13*a*) of the second coupling portion (13). In one aspect according to any one of the preceding aspects the central body (12*a*), in the first closed condition of the container and in the first operating position of the first coupling portion (12), faces, optionally fully faces, the through pocket (13*a*). In one aspect according to any one of the preceding aspects the central body (12*a*) is substantially counter-shaped with respect to the through pocket (13*a*). In one aspect according to any one of the preceding aspects the central body (12*a*) has a substantially quadrilateral shape, optionally rectangular. In one aspect according to any one of the preceding aspects the through pocket (13*a*) has a substantially quadrilateral shape, optionally rectangular.

In one aspect according to any one of the preceding aspects the at least one tab (12*b*) is integrally joined to the central body (12*a*). In one aspect according to any one of the preceding aspects the at least one tab is joined to the central body by means of a folding edge (21). In one aspect according to any one of the preceding aspects the at least one tab (12*b*) is foldable with respect to the central body (12*a*) at least at the folding edge. In one aspect according to any one of the preceding aspects the central body (12*a*) and the at least one tab (12*b*) define a surface size greater than a passage section of the through pocket (13*a*) of the second coupling portion (13).

In one aspect according to any one of the preceding aspects the undercut portion (13*b*) of the second coupling portion (13), during the passage of the first coupling portion (12) from the first to the second operating position, intercepts the at least one tab (12*b*) in order to allow the folding thereof with respect to the central body (12*a*), optionally at the folding edge (21). In one aspect according to any one of the preceding aspects the at least one tab is configured for being folded with respect to the central body (12*a*) in order to allow at least one part of the central body (12*a*) and the tab itself to pass through the through pocket (13*a*) of the second coupling portion.

In one aspect according to any one of the preceding aspects the tab (12*b*), in the second operating position of the first coupling portion (12), defines a respective undercut portion of the first coupling portion (12) itself facing the undercut portion (13*b*) of the second coupling portion (13). In one aspect according to any one of the preceding aspects the tab (12*b*), in the first closed condition of the container and in the second operating position of the first coupling portion (12), is entirely arranged in the internal volume (3) of the support (2). In one aspect according to any one of the preceding aspects the at least one tab (12*b*), at least during the passage from the first to the second operating position, is configured for being folded with respect to the central body (12*a*) at the folding edge (21).

In one aspect according to any one of the preceding aspects the central body (12*a*) is substantially extended along a development plane, in which the at least one tab (12*b*) is extended along a respective development plane. In one aspect according to any one of the preceding aspects the development planes of the central body (12*a*) and of the tab (12*b*), at least in the first operating position of the first coupling portion (12), are substantially parallel to each other. In one aspect according to any one of the preceding aspects the development plane of the at least one tab (12*b*), at least in the second operating position, is tilted with respect to the respective development plane of the central body (12*a*).

In one aspect according to any one of the preceding aspects the at least one tab (12*b*) comprises a first and a second tab (12*b*', 12*b*"). In one aspect according to any one of the preceding aspects the first and second tabs (12*b*', 12*b*") are integrally joined to the central body (12*a*). In one aspect according to any one of the preceding aspects the first and second tabs are arranged one opposite the other with respect to the central body (12*a*). In one aspect according to any one of the preceding aspects the first and second tabs (12*a*', 12*a*") are configured for being folded with respect to the central body (12*a*), during the passage of the first coupling portion (12) from the first to the second operating position.

In one aspect according to any one of the preceding aspects the first and second tabs (12*b*', 12*b*"), in the second operating position of the first coupling portion (12), define a substantially "C" or "U" shape whose concavity faces the internal volume (3) and/or towards the closure system (7). In one aspect according to any one of the preceding aspects the first and second tabs (12*b*', 12*b*"), in the first closed condition of the container and in the first operating position of the first coupling portion (12), both face the undercut portion (13*b*) of the second coupling portion (13). In one aspect according to any one of the preceding aspects the central body (12*a*) and the at least one tab (12*b*) are aligned along a transverse direction and define a width of the first coupling portion (12); optionally, said width being measured along said transverse direction. In one aspect according to any one of the preceding aspects the through pocket (13*a*) of the second coupling portion (13) has width—measured along a respective direction parallel to said transverse direction of the first coupling portion—smaller than the width of the first coupling portion (12).

In one aspect according to any one of the preceding aspects the first tab (12*b*'), the central body (12*a*) and the second tab (12*b*) are aligned along a transverse direction and define a width of the first coupling portion (12); optionally, said width being measured along said transverse direction.

In one aspect according to any one of the preceding aspects the through pocket (13*a*) of the second coupling portion (13) has width—measured along a respective direction parallel to said transverse direction of the first coupling portion—smaller than the width of the first coupling portion (12). In one aspect according to any one of the preceding aspects the through pocket (13*a*) is delimited width-wise by the undercut portion (13*b*).

In one aspect according to any one of the preceding aspects the second coupling portion (13) comprises at least one locking tab (24) emerging from the undercut portion (13*b*), at least partly closing the through pocket (13*a*). In one aspect according to any one of the preceding aspects the locking tab (24), at least in the first closed condition of the container and at least in the first operating position of the first coupling portion (12), substantially lies parallel to the abutment flap (2*c*). In one aspect according to any one of the preceding aspects the locking tab (24) is integrally joined to the undercut portion (13*b*) of the second coupling portion (13) by means of at least one respective folding edge (13*c*). In one aspect according to any one of the preceding aspects the at least one locking tab (24), during the passage of the first coupling portion (12) from the first to the second operating position, is configured for being folded with respect to the undercut portion (13*b*) of the second coupling portion (13), at least partly in the internal volume of the support (2) in order to allow the passage of at least part of the first coupling portion (12). In one aspect according to any one of the preceding aspects the locking tab (24), at least in the locking condition, substantially faces a portion of the central body (12*a*) of the first coupling portion (12) arranged in the internal volume (3) of the support (2). In one aspect according to any one of the preceding aspects at least one part of the locking tab (24), at least in the locking condition, is substantially interposed between the through pocket (13*a*) of the second coupling portion (13) and the at least one part of the first coupling portion (12) arranged in the internal volume (3) of the support (2). In one aspect according to any one of the preceding aspects the locking tab (24), at least in the second operating position of the first coupling portion (12), at least partly obstructs the through pocket (13*a*) of the second coupling portion (13). In one aspect according to any one of the preceding aspects the locking tab (24), at least in the second operating position of the first coupling portion (12), is folded with respect to the undercut portion (13*b*) towards the at least one tab (12*b*) of the first coupling portion (12). In one aspect according to any one of the preceding aspects the locking tab (24), at least in the second operating position of the first coupling portion (12), is configured for preventing the passage of the part of the first coupling portion arranged in the internal volume through the through pocket (13*a*).

In one aspect according to any one of the preceding aspects the locking tab (24) is movable with respect to the abutment flap (2*c*) at least between:

- a flat position in which substantially lies parallel to the abutment flap (2*c*);
- a tilted position in which it lies transverse to the abutment flap (2*c*).

In one aspect according to any one of the preceding aspects the locking tab (24) is movable via rotation from the flat position to the tilted position by means of the thrust of the first coupling portion (12), during the passage of the latter from the first to the second operating position.

In one aspect according to any one of the preceding aspects the through pocket (13*a*) is delimited by a perimeter edge, in which the at least one locking tab (24) is engaged at a section of the perimeter edge of the through pocket (13*a*). In one aspect according to any one of the preceding aspects the at least one locking tab (24) comprises a first and a second locking tab (24', 24") respectively engaged with opposite portions of the undercut portion (13*b*). In one aspect according to any one of the preceding aspects the through pocket (13*a*) is perimetrically delimited by a perimeter edge, in which the first and second locking tabs (24', 24") are engaged with opposite sections of the perimeter edge of the through pocket (13*a*) of the second coupling portion (13) and both being arranged at least partly closing said through pocket (13*a*). In one aspect according to any one of the preceding aspects the at least one tab (24)—optionally the first and second tabs (24', 24")—are integrally joined to the undercut portion (13*b*) of the second coupling portion (13). In one aspect according to any one of the preceding aspects the first and second locking tabs (24', 24") are movable via rotation with respect to the abutment flap (2*c*) of the support between the flat position and the tilted position. In one aspect according to any one of the preceding aspects the first and second tabs (24', 24"), in the flat position, are substantially parallel to each other and abutted against each other. In one aspect according to any one of the preceding aspects the first and second tabs (24', 24"), in the tilted position, are tilted and spaced with respect to each other.

In one aspect according to any one of the preceding aspects the second coupling portion (13), optionally the through pocket (13*a*), is defined, optionally entirely, on the abutment flap (2*c*). In one aspect according to any one of the preceding aspects each abutment flap (2*c*) is extended lengthwise between a first and a second longitudinal end portion. In one aspect according to any one of the preceding aspects the at least one second coupling portion (13) is defined at at least one between said first and second longitudinal end portions of the abutment flap (2*c*). In one aspect according to any one of the preceding aspects the second coupling portion (13) is defined by a part of the abutment flap (2*c*).

In one aspect according to any one of the preceding aspects the first coupling portion (12) comprises a base body (12*c*) integrally joined to the central body (12*a*) by means of a respective folding edge (22). In one aspect according to any one of the preceding aspects the central body (12*a*) of the first coupling portion (12) is foldable with respect to the base body (12*c*) around said folding edge (22) in order to allow at least one part of the central body (12*a*) itself, during the passage from the first to the second operating position, to pass through the through pocket (13*a*) in order to be arranged at least partly in the internal volume (3) of the support (2).

In one aspect according to any one of the preceding aspects the folding edge (22) which connects the central body (12*a*) and the base body (12*c*) is extended transversely, optionally orthogonally, with respect to the folding edge (21) that joins said base body (12*a*) from the at least one tab (12*b*). In one aspect according to any one of the preceding aspects the folding edge (22) which connects the central body (12*a*) and the base body (12*c*) is separate with respect to the folding edge (21) that joins said base body (12*a*) from the at least one tab (12*b*).

In one aspect according to any one of the preceding aspects the first coupling portion (12), at least during the passage from the first to the second operating position, is configured for being folded along two separate folding edges.

In one aspect according to any one of the preceding aspects the second coupling portion (13) comprises at least one contrast portion (30) which delimits, with the undercut portion (13*b*), at least part of the through pocket (13*a*). In one aspect according to any one of the preceding aspects the base body (12*c*) of the first coupling portion (12), in the first closed condition of the container and in the first operating position of the first coupling portion, faces the contrast portion (30).

In one aspect according to any one of the preceding aspects the base body (12*c*), during the passage of the first coupling portion (12) from the first to the second operating position, is configured for contacting the contrast portion (30) and allowing the central body (12*a*) and the at least one tab (12*b*) to be folded around said contrast portion (30) in order to pass through the through pocket (13*a*).

In one aspect according to any one of the preceding aspects the removable portion is defined by at least one part of the first coupling portion (12). In one aspect according to any one of the preceding aspects the removable portion is defined entirely by the first coupling portion (12). In one aspect according to any one of the preceding aspects the entire first coupling portion (12) defines the removable portion.

In one aspect according to any one of the preceding aspects the removable portion (i.e. the first coupling portion 12) is integrally joined to the closure system (7) by means of at least one weakening portion (23) configured for being broken, following the definition of the locking condition, during the passage of the closure system (7) from the first closed condition to the first open condition. In one aspect according to the preceding aspect the removable portion defined by the first coupling portion (12) is integrally joined to the closure system (7) by means of a connection flap, in which said connection flap comprises a plurality of notches adapted to allow the tearing (optionally facilitated) of the connection flap. In one aspect according to the preceding aspect the notched connection flap defines the weakening portion adapted to connect the removable portion to the closure system (7). In one aspect according to any one of the preceding aspects the removable portion defined by said first coupling portion (12) is engaged with the closure system only by means of said weakening portion (23).

In one aspect according to any one of the preceding aspects at least one among the base body (12*c*), the central body (12*a*) and the at least one tab (12*b*) is joined to the closure system (7) by means of a weakening portion (23). In one aspect according to any one of the preceding aspects only the base body (12*c*) is joined to the closure system (7) by means of at least one weakening portion (23).

In one aspect according to any one of the preceding aspects the first coupling portion (12), optionally the removable portion, is obtained by means of a through cut action of the closure system (7).

In one aspect according to any one of the preceding aspects the weakening portion (23) is separate and spaced from the folding edge (22) which integrally joins the central body (12*a*) and the base body (12*c*) of the first coupling portion (12).

In one aspect according to any one of the preceding aspects the closure system (7) has at least one through seat delimited by a perimeter edge (7*a*). In one aspect according to any one of the preceding aspects the perimeter edge (7*a*) of the through seat has closed profile. In one aspect according to any one of the preceding aspects the removable portion is engaged with at least one section of the perimeter edge (7*a*) of said through seat (7*a*) by means of the at least one weakening portion (23). In one aspect according to any one of the preceding aspects said removable portion, at least in the first operating position, is arranged within said through seat. In one aspect according to any one of the preceding aspects the first coupling portion (12) is engaged with the perimeter edge (7*a*) of the at least one through seat of the closure system (7) by means of the at least one weakening portion (23) to define said removable portion.

In one aspect according to any one of the preceding aspects the contrast portion (30) comprises an indicator which, in the closed condition of the container and following the first open condition of the latter, is visible through the through seat of the closure system (7). In one aspect according to any one of the preceding aspects the indicator is configured for signaling the absence of the removable portion, optionally signaling the execution of a first open condition thereof following a first closed condition.

In one aspect according to any one of the preceding aspects the removable portion has an exposed surface which, in the first closed condition of the container, is visible from outside the container, in which the indicator of the contrast portion (30) defines a signaling surface visible through the through seat of the closure system (7) in the absence of the removable portion, optionally at least in a closed condition of the container following the first open condition.

In one aspect according to any one of the preceding aspects the signaling surface of the contrast portion (30) is visibly different from the exposed surface of the removable portion. In one aspect according to any one of the preceding aspects the signaling surface of the indicator is configured for allowing a user to verify the absence of the removable portion following the first open condition of the container.

In one aspect according to any one of the preceding aspects the closure system (7) comprises a closure panel (8) which—in the closed condition of the container (1)—is placed to close the passage opening (5), at least partly in contact with the abutment flap (2*c*). In one aspect according to any one of the preceding aspects the closure panel (8) is delimited by an external perimeter edge (8*a*). In one aspect according to any one of the preceding aspects the at least one first coupling portion (12) is defined on the closure panel (8). In one aspect according to any one of the preceding aspects the first coupling portion (12) is entirely defined within the external perimeter edge of the closure panel (8).

In one aspect according to any one of the preceding aspects the closure system (7) has at least one connection tongue (25) emerging from at least one section of the external perimeter edge (8*a*) of the closure panel and configured for being arranged, at least in the closed condition of the closure system (7), in the internal volume (3) of the support (2 In one aspect according to any one of the preceding aspects the support (2) has—at the abutment flap (2*c*) and at the free edge (6)—at least one slit (27) configured for allowing the passage of the connection tongue (25), optionally at least during the passage of the closure system from the open condition to the closed one. In one aspect according to any one of the preceding aspects the slit (27) is defined on the abutment flap (2*c*).

In one aspect according to any one of the preceding aspects the support (2) comprises at least one intermediate flap (26) emerging from at least one section of the free edge (6) and at least partly facing the base (2*a*), in which said at least one intermediate flap (26) at least partly delimits the passage opening (5) of the support configured for placing in communication the internal volume (3) with the external environment, in which the intermediate flap (26) is configured for being at least partly superimposed on the abutment flap (2*c*) and being interposed, in the closed condition of the container (1), between a portion of the abutment flap (2*c*) and a portion of the closure system (7).

In one aspect according to any one of the preceding aspects the intermediate flap (26) has a through opening (28) delimited by a perimeter edge which, at least in the closed condition of the container, faces the through pocket (13*a*) of the second coupling portion (13). In one aspect according to any one of the preceding aspects the perimeter edge of the through opening (28) of the intermediate flap (26) has a closed profile. In one aspect according to any one of the preceding aspects the through opening (28) of the intermediate flap (26) is configured for allowing the passage of the first coupling portion (12), during the passage of the latter from the first to the second operating position, in order to allow said first engagement portion (12) to reach and pass through the through pocket (13*a*).

In one aspect according to any one of the preceding aspects the intermediate flap (26) comprises at least one first and a second intermediate flap (26', 26") respectively emerging from opposite sections of the free edge (6) of the support (2).

In one aspect according to any one of the preceding aspects the at least one intermediate flap (26), optionally the first and the second intermediate flap (26', 26"), has at least one slit (27) defined at the free edge (6) of the support (2) and configured for allowing the passage of the at least one connection tongue (25) of the closure system, at least during the passage of the closure system from the open condition to the closed one.

In one aspect according to any one of the preceding aspects the at least one lateral wall (4) of the support (2) has at least one air-vent opening (17) configured for allowing, at least in the closed condition of the container, the fluid communication between the internal volume (3) and the external environment. In one aspect according to any one of the preceding aspects the air-vent opening (17) is configured for allowing the air present in the internal volume to vent (3) outside the container (1).

In one aspect according to any one of the preceding aspects the support (2) comprises at least one first and a second lateral wall (4*a*, 4*b*) emerging, one adjacent to the other, from an external perimeter hole of the base (2*a*). In one aspect according to any one of the preceding aspects at least said first lateral wall (4*a*) comprises the air-vent opening (17). In one aspect according to any one of the preceding aspects the second lateral wall (4*b*) comprises a junction portion (18) configured for being at least partially superimposed on the first lateral wall (4*a*) outside the internal volume (3), in which said second lateral wall (4*b*) comprises a locking tongue (70) configured for being inserted within the air-vent opening (17) of the first lateral wall (4*a*) in order to allow the constraint of said first and second lateral wall (4*a*, 4*b*). In one aspect according to any one of the preceding aspects the junction portion (18) comprises a superimposition tongue on which a through opening is defined that is delimited by a perimeter edge, in which the through opening faces the air-vent opening (17) of the first lateral wall (4*a*). In one aspect according to any one of the preceding aspects the locking tongue (70) is constrained to the perimeter edge of the through opening of the superimposition tongue and movable via rotation with respect to said perimeter edge between a position in which it faces the air-vent opening (17) and a position in which it is folded within said air-vent opening (17) in order to constrain the first and the second lateral wall (4*a*, 4*b*).

In one aspect according to any one of the preceding aspects the support (2) comprises at least one first lateral wall (4*a*), at least one second lateral wall (4*b*) and at least one third lateral wall (4*c*). In one aspect according to any one of the preceding aspects said first, second and third lateral wall (4*a*, 4*b*, 4*c*) emerge from the base (2*a*), optionally from an external perimeter edge of the base (2*a*), substantially along a same direction, in which the abutment flap (2*c*) emerges from at least one section of the free edge defined by the first lateral wall (4*a*).

In one aspect according to any one of the preceding aspects the container comprises at least one second coupling portion (13) defined on the abutment flap (2*c*) carried by the first lateral wall (4*a*).

In one aspect according to any one of the preceding aspects the closure system (7) is engaged, optionally movable via rotation, with at least one section of the free edge (6) of the support defined by at least one between the second and the third lateral wall (4*b*, 4*c*). In one aspect according to any one of the preceding aspects the abutment flap (2*c*) is integrally joined to the at least one lateral wall and folded with respect to the latter at the free edge (6). In one aspect according to any one of the preceding aspects at least one between the second and the third lateral wall (4*b*, 4*c*) stably carry the intermediate flap (26).

In one aspect according to any one of the preceding aspects the base (2*a*) of the support (2) has a quadrilateral shape, optionally substantially square. In one aspect according to any one of the preceding aspects the support (2) comprises at least one first lateral wall (4*a*), at least one second lateral wall (4*b*), at least one third lateral wall (4*c*) and at least one fourth lateral wall (4*b*). In one aspect according to any one of the preceding aspects said first, second, third and fourth lateral wall (4*a*, 4*b*, 4*c*, 4*d*) emerging from the base (2*a*), optionally from an external perimeter edge of the base (2*a*), substantially along a same direction. In one aspect according to any one of the preceding aspects the first and the third lateral wall are opposite each other with respect to the base (2*a*) while the second and the fourth lateral wall are opposite each other with respect to the base (2*a*). In one aspect according to any one of the preceding aspects the first and the third lateral wall (4*a*, 4*c*) are connected to each other by means of the second and fourth lateral walls (4*b*, 4*d*). In one aspect according to any one of the preceding aspects the abutment flap (2*c*) emerges from at least one section of the free edge (6) defined by at least one of said lateral walls (4*a*, 4*b*, 4*c*, 4*d*). In one aspect according to any one of the preceding aspects the abutment flap (2*c*) emerges from a section of the free edge (6) of the support (2) defined by the first lateral wall (4*a*). In one aspect according to any one of the preceding aspects the at least one intermediate flap (26) emerges from at least one section of the free edge (6) of the support (2) defined by the second and/or by the fourth lateral wall (4*b*, 4*d*).

In one aspect according to any one of the preceding aspects the abutment flap (2*c*) emerges from a section of the free edge (6) of the support (2) defined by the second and by the fourth lateral wall (4*b*, 4*d*). In one aspect according to any one of the preceding aspects the at least one intermediate flap (26) emerges from at least one section of the free edge (6) of the support (2) defined by the first lateral wall (4*a*).

In one aspect according to any one of the preceding aspects the closure system (7) is hinged to the third lateral wall (4*c*). In one aspect according to any one of the preceding aspects the closure system (7) is hinged to the free edge (6) of the support defined by the third lateral wall (4*c*). In one aspect according to any one of the preceding aspects the first lateral wall (4*a*) defines a front wall (4*a*) of the support while the third lateral wall (4*c*) defines a rear wall of the support.

In one aspect according to any one of the preceding aspects the container comprises at least one separator (14) that emerges from the abutment flap (2*c*) in the direction of the base (2*a*). In one aspect according to the preceding aspects the separator connects the abutment flap (2*c*) to the base (2*a*) of the support (2). In one aspect according to any one of the preceding aspects the container comprises a separator connecting the abutment flap (2*c*) to the base (2*a*) of the support (2). In one aspect according to any one of the preceding aspects the separator (14) essentially defines an internal wall of the support (2) spaced from the lateral wall (4), optionally by means of said abutment flap (2*c*). In one aspect according to any one of the preceding aspects the separator (14) is extended into the internal volume (3) of the support (2). In one aspect according to any one of the preceding aspects the separator (14) is configured for dividing a central zone of the support (2) adapted to receive the product from a peripheral zone of the support, optionally at which the abutment flap (2*c*) is present. In one aspect according to any one of the preceding aspects the separator (14) is engaged directly with the abutment flap (2*c*). In one aspect according to any one of the preceding aspects the separator (14) is integrally joined to the abutment flap (2*c*). In one aspect according to any one of the preceding aspects the separator (14) is folded with respect to the abutment flap (2*c*) in the direction of the base (2). In one aspect according to any one of the preceding aspects the separator (14) is spaced from the lateral wall (4) of the support (2).

In one aspect according to any one of the preceding aspects the abutment flap (2*c*) is extended width-wise starting from the free edge (6) up to an opposite end edge (6*a*). In one aspect according to any one of the preceding aspects the separator (14) is integrally joined to the abutment flap (2*c*) at said end edge (6*a*). In one aspect according to any one of the preceding aspects the separator (14) is integrally joined and folded with respect to the abutment flap (2*c*) at the end edge (6*a*).

In one aspect according to any one of the preceding aspects the abutment flap (2*c*) is extended lengthwise substantially along the free edge (6) of the support (2) defined by at least one lateral wall. In one aspect according to any one of the preceding aspects the abutment flap (2*c*) is extended lengthwise substantially along the entire section of the free edge defined by the first lateral wall (4*a*). In one aspect according to any one of the preceding aspects the abutment flap (2*c*) is extended lengthwise substantially along the entire section of the free edge defined by the second and by the fourth lateral wall (4*b*, 4*d*).

In one aspect according to any one of the preceding aspects the separator (14) is extended lengthwise substantially for the entire length of the abutment flap (2*c*), to which said separator is integrally joined to define a channel. In one aspect according to any one of the preceding aspects the channel is placed at a peripheral zone of the support (2). In one aspect according to any one of the preceding aspects the channel is configured for allowing the passage of air.

In one aspect according to any one of the preceding aspects the separator (14) is configured for dividing the internal volume (3) of the support (2) into a first and a second sub-chamber (40, 45). In one aspect according to any one of the preceding aspects the first sub-chamber (40) defines said at least one central zone of the support (2) adapted to receive the product. In one aspect according to any one of the preceding aspects the second sub-chamber (45) is delimited by the channel. In one aspect according to any one of the preceding aspects the second sub-chamber (optionally the channel) is arranged at a peripheral zone of the support (2), optionally alongside the central zone.

In one aspect according to any one of the preceding aspects the separator (14) comprises at least one through access (16) configured for placing in fluid communication the first and the second sub-chambers.

In one aspect according to any one of the preceding aspects the separator (14) is arranged at least partially facing the air-vent opening (17). In one aspect according to any one of the preceding aspects the through access (16) defined on the separator (14) is offset with respect to the air-vent opening (17). In one aspect according to any one of the preceding aspects the through access (16) does not face the air-vent opening (17).

In one aspect according to any one of the preceding aspects the channel is delimited by a lateral wall (4), by the separator (14), by the abutment flap (2*c*) and by the base (2*a*) of the support (2). In one aspect according to any one of the preceding aspects the separator (14) is extended transversely to the base (2*a*). In one aspect according to any one of the preceding aspects the separator (14) is engaged, e.g. by means of gluing, to the base (2*a*) of the support (2). In one aspect according to any one of the preceding aspects the separator (14) comprises a plurality of through accesses (16) distributed along the length of the separator.

In one aspect according to any one of the preceding aspects the container (1) comprises a plurality of separators (14), one for each abutment flap (2*c*).

In one aspect according to any one of the preceding aspects the through pocket (13*a*) of the second coupling portion (13) is defined on the abutment flap (2*c*) defining, in cooperation with the separator (14), said channel.

In one aspect according to any one of the preceding aspects the through pocket (13*a*) of the second coupling portion (13) is in direct fluid communication only with the second sub-chamber (45). In one aspect according to any one of the preceding aspects the through pocket (13*a*) of the second coupling portion (13) does not directly communicate with the first sub-chamber (40).

In one aspect according to any one of the preceding aspects the at least one air-vent opening (17) is directly in fluid communication only with the second sub-chamber (45) delimited by the channel.

In one aspect according to any one of the preceding aspects the separator (14) is interposed between the lateral wall (4) of the support (2) on which the air-vent opening (17) is defined and the central zone of the support adapted to receive the product. In one aspect according to any one of the preceding aspects the air-vent opening (17) does not directly communicate with the first sub-chamber (40).

In one aspect according to any one of the preceding aspects the separator (14) comprises a plurality of through accesses (16) distributed along the length of the separator itself. In one aspect according to any one of the preceding aspects each separator (14) is at least partly engaged with a respective abutment flap (2*c*), said separator (14), in cooperation with the abutment flap (2*c*) with which it is directly engaged (optionally integrally joined), defines a respective channel in communication with the internal volume of the container (2) by means of at least one through access (16).

In one aspect according to any one of the preceding aspects at least one lateral wall of the support (2) has a plurality of through holes (17) each of which facing at least one channel of said plurality of separators (14).

In one aspect according to any one of the preceding aspects the abutment flap (2*c*) emerges from, and optionally is integrally joined by at least one part of a section of the free edge defined by at least one of the following lateral walls: the first lateral wall (4*a*), the second lateral wall (4*b*) and the fourth lateral wall (4*d*). In one aspect according to any one of the preceding aspects the abutment flap (2*c*) emerges, and optionally is integrally joined, by at least one part of a section of the free edge (6) defined by the first lateral wall (4*a*). In one aspect according to any one of the preceding aspects the separator emerges from the abutment flap (2*c*) in a manner such to face the first lateral wall (4*a*).

In one aspect according to any one of the preceding aspects the first lateral wall (4*a*) and the separator (14) are both extended lengthwise along respective longitudinal directions that are substantially parallel to each other.

In one aspect according to any one of the preceding aspects the first lateral wall (4*a*) and the separator (14) are both extended lengthwise along respective directions parallel to the section of free edge defined by the first lateral wall (4*a*). In one aspect according to any one of the preceding aspects the first lateral wall (4*a*) and the separator (14) essentially have the same length. In one aspect according to any one of the preceding aspects the separator is substantially extended parallel to the first lateral wall (4*a*).

In one aspect according to any one of the preceding aspects the abutment flap (2*c*) is substantially extended parallel to the base (2*a*).

In one aspect according to any one of the preceding aspects the separator and the first lateral wall (4*a*) have respective heights, measured orthogonally to the base (2*a*), that are substantially identical.

In one aspect according to any one of the preceding aspects the support (2) has at least one air-vent opening (17) defined on said first lateral wall (4*a*). In one aspect according to any one of the preceding aspects the support (2) comprises two air-vent openings (17) defined at opposite longitudinal ends of said first lateral wall (4*a*). In one aspect according to any one of the preceding aspects said first longitudinal end portion is defined at the second lateral wall (4*b*) while the second longitudinal end portion is defined at the fourth lateral wall (4*d*).

In one aspect according to any one of the preceding aspects the abutment flap (2*c*) is extended starting from the first lateral wall (4*a*) substantially in the direction of the third lateral wall (4*c*).

In one aspect according to any one of the preceding aspects the at least one abutment flap (2*c*) of the support (2) comprises:

- a first abutment flap emerging, and optionally integrally joined, by at least one part of a section of the free edge (6) defined by the second lateral wall (4*b*),
- a second abutment flap emerging, and optionally integrally joined, by at least one part of a section of the free edge (6) defined by the fourth lateral wall (4*d*).

In one aspect according to any one of the preceding aspects the at least one separator (14) comprises at least one first and at least one second separator respectively integrally joined and emerging from the first and second abutment flap.

In one aspect according to any one of the preceding aspects the intermediate flap (26) is extended starting from the first lateral wall (4*a*) substantially in the direction of the third lateral wall (4*c*). In one aspect according to any one of the preceding aspects the at least one intermediate flap (26) comprises:

a first intermediate flap emerging, and optionally integrally joined, by at least one part of a section of the free edge (6) defined by the second lateral wall (4*b*), a second intermediate flap emerging, and optionally integrally joined, by at least one part of a section of the free edge (6) defined by the fourth lateral wall (4*d*).

In one aspect according to any one of the preceding aspects the width of each intermediate flap is measured orthogonally to the longitudinal extension direction of the same flap which is substantially extended from the first to the second longitudinal end portion. In one aspect according to any one of the preceding aspects each abutment flap (2*c*) has a width smaller than the length of the same abutment flap (2*c*). In one aspect according to any one of the preceding aspects each abutment flap (2*c*) has a predetermined width, in which the at least one lateral wall (4) has a predetermined height measured perpendicular to the base (2*a*) of the support, in which the ratio between the height of the at least one lateral wall (4) of the support (2) and the width of the abutment flap (2*c*) is comprised between 0.5 and 2, optionally between 0.7 and 1.5.

In one aspect according to any one of the preceding aspects the second coupling portion (13) is defined at a corner zone of the support. In one aspect according to any one of the preceding aspects the first coupling portion (12) is defined at a respective corner portion of the closure system (7).

In one aspect according to any one of the preceding aspects the at least one intermediate flap (26) is extended lengthwise along a main extension direction between a first and a second longitudinal end portion. In one aspect according to any one of the preceding aspects the intermediate flap (26) is extended along the entire section of a free edge (6) of the support (2) defined by the lateral wall with which said intermediate flap (26) is directly integrally joined.

In one aspect according to any one of the preceding aspects the intermediate flap (26) has a width, measured orthogonally to the main extension direction of said intermediate flap (26), which is substantially identical to the width of the abutment flap (2*c*).

In one aspect according to any one of the preceding aspects the container is of tamper-proof type and is configured for housing food products, e.g. pizza. In one aspect according to any one of the preceding aspects the container is for containing food products, e.g. pizza.

In one aspect according to any one of the preceding aspects the intermediate flap (26) comprises at least one contrast portion (30) which delimits at least part of the through opening (28). In one aspect according to any one of the preceding aspects the base body (12*c*) of the first coupling portion (12), in the first closed condition of the container and in the first operating position of the first coupling portion, faces the contrast portion (30). In one aspect according to any one of the preceding aspects the base body (12*c*), during the passage of the first coupling portion (12) from the first to the second operating position, is configured for contacting the contrast portion (30) and allowing the central body (12*a*) and the at least one tab (12*b*) to be folded around said contrast portion (30) in order to pass through the through pocket (13*a*).

In one aspect according to any one of the preceding aspects the contrast portion (30) comprises an indicator that is visible, in the closed condition of the container and following the first open condition of the latter, through the through seat of the closure system (7).

In one aspect according to any one of the preceding aspects at least one between the support (2) and the closure system (7) comprises at least one tear portion (9, 19) configured for allowing the breakage of said support and/or container during an attempt to open the container itself when this is arranged in the locking condition. In one aspect according to the preceding aspect the support (2) comprises at least one tear portion (19). In one aspect according to the two preceding aspects the closure system (7) comprises at least one tear portion (9). In one aspect according to the preceding aspect the tear portion (9) defined on the closure system (7) is separate and spaced from the removable portion defined at least partly by said first coupling portion (12). In one aspect according to the three preceding aspects each tear portion (9) of the closure system (7) comprises at least one notch, optionally a plurality of notches aligned along a predetermined trajectory and placed one after the other, defined on the closure portion (8) and extended substantially starting from the perimeter edge of said closure portion. In one aspect according to any one of the preceding aspects the closure system comprises a plurality of tear portions (9) configured for allowing the breakage of the closure system (7) itself during an access attempt of a user in the locking condition of the container.

In one aspect a process is provided for making a container (1) in accordance with any one of the preceding aspects. In one aspect according to any one of the preceding aspects, the process comprises the following steps:

arranging at least one first blank (50) of sheet material extended along a plane, said first blank (50) comprising:

a central sheet (51), at least one first lateral sheet (52) integrally joined to the central sheet (51) and emerging from the latter starting from a perimeter edge, at least one second lateral sheet (53) integrally joined to the first lateral sheet on the side opposite the central sheet (51), in which said first lateral sheet (52) is interposed between said central sheet (51) and said second lateral sheet, arranging the closure system (7) by means of at least one second blank (60) of sheet material extended along a plane, in which the process comprises the steps of:

folding the at least one first lateral sheet (52) of the first blank (50) with respect to the central sheet (51) in a manner such that said central sheet (51) of the first blank (50) defines the base (2*a*) of the support (2) while the at least one first lateral sheet (52) defines the at least one lateral wall (4) of the support (2), folding the at least one second lateral sheet (53) of the first blank with respect to the first lateral sheet (52) in a manner such that said second lateral sheet (53) defines the abutment flap (2*c*) of the support (2).

In one aspect according to any one of the preceding aspects the process also comprises the steps of:

defining on the closure system the at least one first coupling portion (12), defining on the abutment flap (2*c*) the at least one second coupling portion (13).

In one aspect according to any one of the preceding aspects the first and the second blank (50, 60) are integrally joined to define a single flat blank.

In one aspect according to any one of the preceding aspects the central sheet (51) has a quadrilateral shape, optionally has a substantially square shape, in which the first blank (50) comprises a first lateral sheet (52) emerging from each side of the central sheet (51) of the first blank, in which the process provides for the folding of the first lateral sheets (52) of the first blank in a manner such that the latter can define the first, the second, the third and the fourth lateral walls (4*a*, 4*b*, 4*c*, 4*d*) of the support (2).

In one aspect according to any one of the preceding aspects the second blank (60) is integrally joined to a first lateral sheet (52) of the first blank (50) in a manner such that said first lateral sheet (52) is interposed between the second blank (60) and the central sheet (51).

In one aspect according to any one of the preceding aspects the arrangement of the first coupling portion (12) provides for the execution of a through notch on the second blank (60). In one aspect according to any one of the preceding aspects the notching step for executing the first coupling portion (12) is executed in a single step by means of at least one of the following processes: die cutting, laser cutting. In one aspect according to any one of the preceding aspects the through notching step executed on the second blank defines, optionally within an external perimeter edge of said second blank, a seat (61*a*) and a tongue (61*b*) respectively adapted to define the through seat of the closure system (7) and the first coupling portion (12) housed within said through seat. In one aspect according to any one of the preceding aspects the arrangement of the second coupling portion (13) provides for the execution of a through notch (53*a*) on the second lateral sheet (53). In one aspect according to any one of the preceding aspects such notching step for executing the second coupling portion is executed in a single step by means of at least one of the following processes: die cutting, laser cutting. In one aspect according to any one of the preceding aspects the step of through notching (53*a*) executed on the second lateral sheet (53) defines, optionally within an external perimeter edge of said second lateral sheet (53), a seat adapted to define the through pocket (13*a*) of the second coupling portion (13). In one aspect according to any one of the preceding aspects the step of through notching (53*a*) executed on the second lateral sheet (53) defines, optionally within an external perimeter edge of said second lateral sheet (53), at least one tongue (53*b*) adapted to define the at least one locking tab (24) housed in the through pocket (13*a*) of the second coupling portion (13).

In one aspect according to any one of the preceding aspects the first and second blank are made of sheet material paper.

In one aspect according to any one of the preceding aspects the first blank (50) comprises at least one third lateral sheet (54) integrally joined to the second lateral sheet (53) on the side opposite the central sheet (51), in which the process also comprises the step of folding the at least one third lateral sheet (54) of the first blank (50) with respect to the second lateral sheet (53) in a manner such that said third lateral sheet (54) defines the separator (14).

In one aspect according to any one of the preceding aspects the process comprises a step of executing at least one further through notch (52*a*) of the first lateral sheet (52), said further through notch (52*a*) being configured for defining the air-vent opening (17) of the at least one lateral wall. In one aspect according to any one of the preceding aspects the further through notch (52*a*) is executed by means of a single step of die cutting and/or laser cutting.

In one aspect according to any one of the preceding aspects the first blank (50) also comprises a fourth lateral sheet (55) integrally joined to at least one second lateral sheet (52) on the side opposite the central sheet (51), the process also comprises a step of folding the fourth lateral sheet (55) with respect to the second lateral sheet to which said lateral sheet is integrally joined in a manner such that said fourth lateral sheet (55) can define the intermediate flap (26) of the support. In one aspect according to any one of the preceding aspects the process precedes the execution on the fourth lateral sheet (55) of a through notch adapted to define the through opening (28) of the intermediate flap (26). In one aspect according to any one of the preceding aspects the through notch (55*a*) executed on the fourth lateral sheet (55) is attained by means of a single step of die cutting and/or laser cutting.

In one aspect according to any one of the preceding aspects the first blank (50) also comprises a junction sheet (56) is integrally joined to at least one first lateral sheet (52) and arranged adjacent to two first adjacent sheets, the process also comprising a step of folding the junction sheet with respect to the first lateral sheet to which it is integrally joined, above the adjacent first lateral sheet in a manner such that said junction sheet can define the junction portion (18) of the support (2). In one aspect according to any one of the preceding aspects the junction sheet (56) comprises a tongue (56*b*) that is foldable and configured for defining the locking tongue (70) of the support (2).

In one aspect according to any one of the preceding aspects the junction sheet (56) comprises a through notch (56*a*), executable by means of a single step of die cutting and/or laser cutting, within which the tongue (56*b*) of the junction sheet (56) is obtained.

In one aspect according to any one of the preceding aspects the process comprises a step of through notching the first blank (50) at a junction zone between a first lateral sheet (52) and a second lateral sheet (53) and/or between a first lateral sheet (52) and the fourth lateral sheet (55), said through notch being adapted to define the slit (27) of the support (2) adapted to receive the connection tongue (25) of the closure system (7).

In one aspect according to any one of the preceding aspects the first and the second blank are integrally joined and obtainable by means of a single step of die cutting of a semifinished product in a flat sheet.

In one aspect, a method is provided for closing a container (1) in accordance with any one of the preceding aspects. In one aspect according to any one of the preceding aspects the closing method comprises the following steps:

- arranging the closure system (7) in the closed condition in which it at least partly obstructs the passage opening of the support, in which the closure system (7), in the closed condition, faces and at least partly contacts the abutment flap (2*c*),
- pushing the first coupling portion (12) through the through pocket (13*a*) of the second coupling portion in a manner such to at least partly insert said first coupling portion (12) into the internal volume (3) of the support engaging the undercut portion of the second coupling portion.

In one aspect, a use of a container is provided in accordance with any one of the preceding aspects. In one aspect according to any one of the preceding aspects the use comprises containing products of food type, e.g. for pizza.

BRIEF DESCRIPTION OF THE DRAWINGS

Several embodiments and several aspects of the finding will be described hereinbelow with reference to the enclosed drawings, only provided as a non-limiting example in which.

DEFINITIONS AND CONVENTIONS

Figure 1:
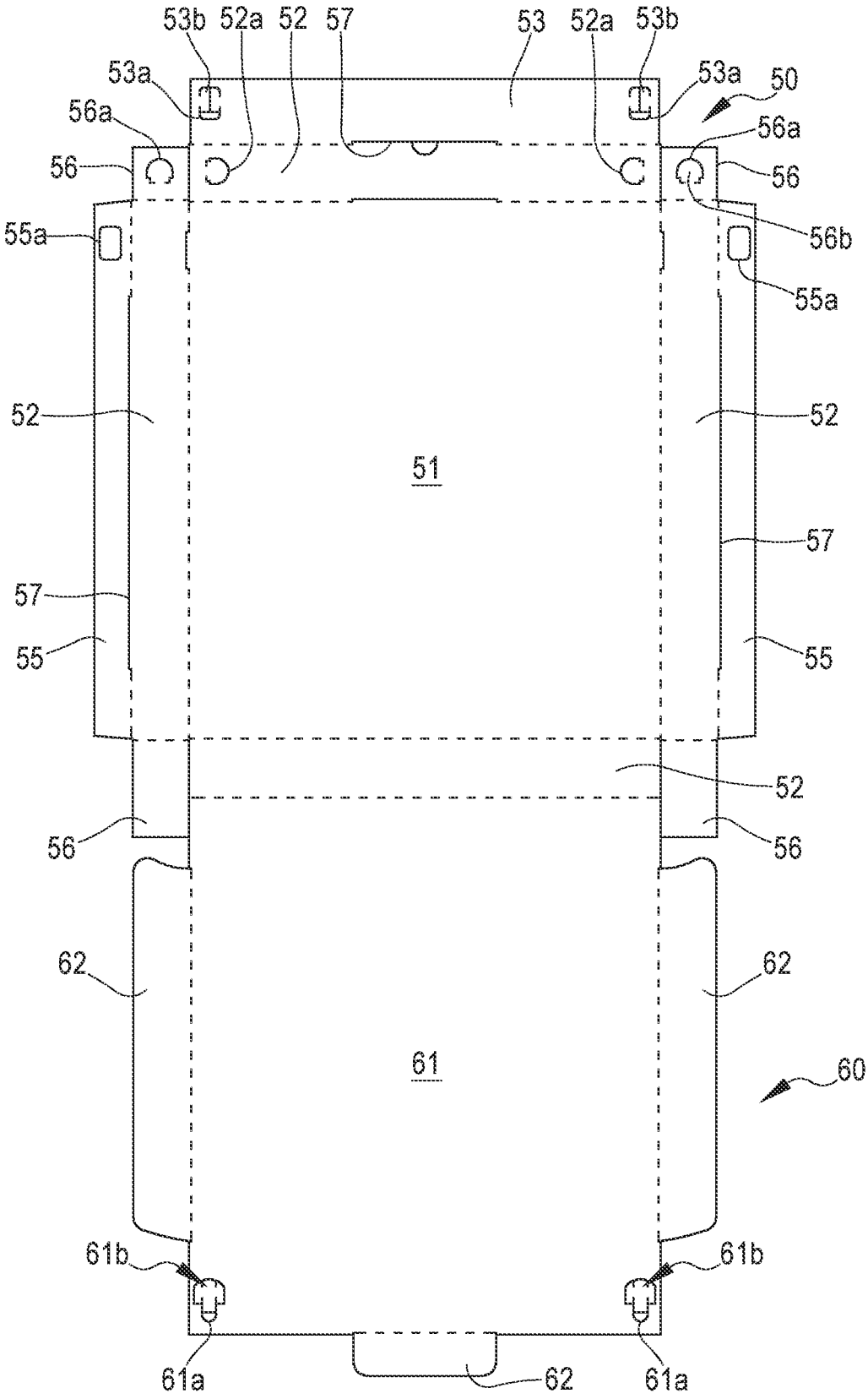
FIG. 1 shows a blank for attaining a first embodiment of a container in accordance with the present invention.

It is observed that in the present detailed description, corresponding parts illustrated in the various figures are indicated with the same numeric references. The figures could illustrate the object of the invention by means of representations that are not in scale; therefore, parts and components illustrated in the figures relative to the object of the invention might only regard schematic representations.

With the term "product" it is intended an article or a composite of articles of any kind. For example, the product can be of food type and be in the solid state, liquid state or in gel form, i.e. in the form of two or more of the aforesaid aggregation states. In the food field, the product can comprise: pizza, pasta, meat, fish, cheese, treated meats, ready and frozen meals of various kind.

With the term "paper" material it is intended paper or cardboard, for example having at least 50% by weight, optionally at least 70% by weight, of organic material comprising one or more of cellulose, hemicellulose, lignin, lignin derivatives. The paper sheet material can be covered at least partly by means of a coating made of plastic material, e.g. a film, whose object is that of: reinforcing the paper sheet material, defining a water and/or moisture barrier. The coating can have a thickness variable between 10 and 50 μm and can be made with one or more of the following materials: LDPE, HDPE, PP, PE.

With the term "blank" it is intended a flat semifinished product made of sheet material, for example paper, foldable on itself in order to make a container. The blank can be made of a single piece and obtainable by means of die cutting a single sheet.

With the term "sheet material" it is intended a material that has two dimensions, for example the length and the width, considerably larger than a third dimension, such as the thickness.

With the term "manually intervene" or "manual intervention" referred to the user, it is intended a manual action performed by the user without the aid of tools.

With the term "support" it is intended an element adapted to receive and support at least one product; the support 2 can comprise at least one base 2*a* and at least one lateral wall 4 emerging from an external perimeter of the base 2*a*; the at least one lateral wall delimits, opposite the base 2*a*, a free edge from which at least one abutment flap 2*c* can emerge: the abutment flap 2*c* is arranged facing the base 2*a* and is substantially extended parallel to the base 2*a* so as to define a kind of internal flange of the support 2.

With the term "flap" it is intended a band of material, for example made of sheet material, having a lengthwise extension along a longitudinal direction greater than a width-wise transverse extension. For example, the flap can comprise a tongue of sheet material paper whose length is at least twice the extension width-wise and in which the length and the width are considerably greater than a third dimension defined by the thickness.

DETAILED DESCRIPTION

Container

Reference number 1 overall indicates a container for housing products, for example of food type. As is visible in the enclosed figures, the container 1 comprises at least one support 2 of sheet material, defining an internal volume 3, configured for housing products, e.g. pizzas, sandwiches or wraps. In particular, the support 2 has at least one base 2*a* with rectangular shape adapted to receive the product, starting from which at least one lateral wall 4 emerges which defines a free edge 6 and, together with the base 2*a*, delimits the internal volume 3.

Indeed, the lateral wall 4 perimetrically delimits the base 2*a* of the support 2 and is configured for emerging from the latter in a manner such to define a three-dimensional shape of the same support 2.

In the enclosed figures, a preferred but non-limiting configuration is illustrated of the support 2, which has a quadrangular prismatic shape (lateral walls 4 that are for example flat and having rectangular shape). However, it is possible to make a support 2 having different shape, e.g. triangular prismatic or trapezoidal. With regard to profile, the lateral wall 4 has a lower height than a longitudinal extension of the same lateral wall. In other words, the lateral wall 4 defines a lateral portion of reduced height to substantially define a tray, configured for housing products having a limited height.

In particular, the support 2 has a first and a second lateral wall 4*a*, 4*b* that are adjacent to each other and configured for being engaged in a manner such to maintain the support 2 in a stable three-dimensional configuration. In detail, the first lateral wall 4*a* is extended along a predetermined extension direction between two longitudinal ends which, following the formation of the support 2, define respective corner portions. The second lateral wall 4*b* is also extended along a predetermined extension direction transversely, optionally orthogonally, with respect to the first lateral wall 4*a*, between respective longitudinal ends: the first and the second lateral wall 4*a*, 4*b* are therefore adjacent to each other at the respective end portions. The first and the second lateral wall 4*a*, 4*b*, following the attainment of the stable three-dimensional configuration, are then engaged with each other to define an external edge of the support 2.

In detail, the first lateral wall can comprise at least one air-vent opening 17 defined at at least one longitudinal end of same first lateral wall 4*a*, configured for allowing the communication between the internal volume 3 of the support 2 and the external environment. The air-vent opening 17 then allows expelling the air and/or the vapor present in the internal volume 3, in a manner such to maintain a constant humidity level within the container itself and consequently preserving the consistency and the taste of the food product.

The air-vent opening 17 is delimited by an undercut portion configured for being constrained with a locking tongue 70 carried by a junction portion 18, in order to define the stable three-dimensional configuration of the support. As is visible for example in FIGS. 2, 6, 8, 12 and 14, the first lateral wall 4*a* can have at least two air-vent openings 17 respectively arranged at opposite longitudinal ends of the first lateral wall 4*a*. Each air-vent opening 17 is thus engageable with a respective locking tongue 70 carried by the second lateral wall 4*b*.

The junction portion 18 comprises a superimposition tongue on which—for example following the attainment of a notch of the same superimposition tongue—a through opening is defined that is delimited by a perimeter edge of substantially circular shape; the locking tongue 70 is defined on the superimposition tongue and is configured to be constrained to the air passage opening 17. The locking tongue 70 is integrally joined to a section of the perimeter edge of the through opening and is movable via rotation with respect to the same edge between a position in which it faces the air-vent opening 17 (in such position the tongue 70 substantially lies parallel to the first lateral wall 4*a*), and a folded position in which the locking tongue 70 is constrained within the air-vent opening 17 in order to engage the first and the second lateral wall 4*a*, 4*b*. The locking tongue 70, in the folded position (FIG. 2), is configured for maintaining the lateral walls of the support in a three-dimensional configuration.

The support 2 can have a third lateral wall 4*c* emerging from the base 2*a* starting from an external perimeter edge of the base 2*a*. The first, the second and the third lateral wall 4*a*, 4*b*, 4*c* emerge from the base 2*a* of the support along a same direction, in a manner such to delimit the internal volume 3. In such configuration, the first, the second and the third lateral wall 4*a*, 4*b* and 4*c* are then adjacent to each other, defining height-wise the triangular prismatic structure of the container. In the latter configuration, the third lateral wall 4*c* can stably carry the locking tongue 70 configured for being engaged with a respective air passage opening 17 defined on the first lateral wall 4*a*.

The support 2 can further comprise a fourth lateral wall 4*d* emerging from the external perimeter edge of the base 2*a*: the first, the second, the third and the fourth lateral wall (4*a*, 4*b*, 4*c*, 4*d*) delimit height-wise the quadrangular prismatic structure of the support 2. As is visible in the enclosed figures, the first and the third lateral wall 4*a*, 4*c* are opposite each other with respect to the base 2*a* of the support; in the same manner, the second and the fourth lateral wall 4*b*, 4*d* face each other and are opposite with respect to the base 2*a* of the support. In fact, the first and the third wall 4*a*, 4*c* respectively define a front wall and a rear wall of the support, joined together by means of the second and of the fourth wall 4*b*, 4*d* which define respective lateral walls of the support. The ends of the first, second, third and fourth lateral walls 4*a*, 4*b*, 4*c*, 4*d* thus delimit the free edge 6.

As shown in FIGS. 2, 11-12 and 14-15, the support 2 comprises an abutment flap 2*c* emerging from at least one section of the free edge 6 so as to at least partly face the base 2*a*. The abutment flap 2*c* can be folded with respect to the section of free edge 6 with which it is engaged in order to define, in cooperation with the free edge 6 (and/or with an intermediate flap 26 described hereinbelow), a passage opening 5 configured for placing the internal volume 3 in communication with the external environment. It should be observed that the abutment flap 2*c* can emerge starting from at least one section of the free edge 6 defined by at least one between the first, the second, the third and the fourth lateral walls 4*a*, 4*b*, 4*c* and 4*d*. However, it is possible that the abutment flap 2*c* can emerge starting from a section of the free edge 6 defined by one or more lateral walls 4. As is visible in FIGS. 2, 11 and 12, the support 2 can comprise an abutment flap 2*c* emerging from the free edge section 6 defined at the first wall 4*a* and facing the third wall 4*c*. Alternatively, the support 2 can comprise a first abutment flap emerging from the second wall 4*c* and a second abutment flap emerging from the fourth wall 4*d*: the first and the second abutment flap are directed towards each other. However, there is the possibility of arranging a plurality of abutment flaps 2*c*, each of which emerging from a respective lateral wall 4.

Each abutment flap 2*c* is extended for the entire longitudinal extension of the lateral wall 4 with which it is engaged. In other words, each abutment flap 2*c* is extended for the entire section of the free edge 6 defined by the lateral wall with which said flap 2*c* is directly carried. With regard to size, the abutment flap 2*c* has a limited extension along a direction facing the internal volume 3 of the support 2, in a manner such to obstruct the access to the internal volume 3 to a limited extent and consequently maximize the extension of the through opening 5: the abutment flap 2*c* then allows an easy insertion of the food product in the internal volume 3. In detail, the extension of the abutment flap 2*c* along a direction entering the internal volume 3 can be comprised between 2 cm and 10 cm, while the ratio between the extension of the abutment flap 2*c* along the direction entering the internal volume 3 and the extension of the lateral wall with which it is engaged can be comprised between 0.06 and 0.3.

The support 2 can also comprise a separator 14 extended in the internal volume 3 interposed between the abutment flap 2*c* and the base 2*a* of the same support 2, configured for dividing a central zone of the support adapted to receive the product, from a peripheral zone of the support at which the abutment flap 2*c* is defined.

In detail, the separator 14 is integrally joined to the abutment flap 2*c* and folded relative to the latter along an end edge 6*a* opposite the free edge 6. The separator 14 can be engaged with the base 2*a* via mechanical interference or via gluing. The separator 14 is extended width-wise between the end edge 6*a* and the base 2*a*.

The separator 14 can be extended transversely, optionally orthogonally, to the abutment flap 2*a* with which it is engaged, thus having equal height with respect to each lateral wall 4. As shown in the enclosed figures, the separator 14 is extended lengthwise substantially for the entire extension of the abutment flap 2*c*, substantially defining a channel delimited by the support 14, by the abutment flap 2*c* and by the lateral wall 4 with which the latter is integrally joined.

However, it is possible to arrange a separator 14 extended along a plurality of discrete sections of the end edge 6*a*, defining an equal number of channels that are separate and spaced from each other.

The separator 14 is also configured for dividing the internal volume 3 in a first sub-chamber 40 configured for receiving the product and in a second sub-chamber 45 delimited by the channel and arranged at a perimeter zone of the support 2.

Figure 8:
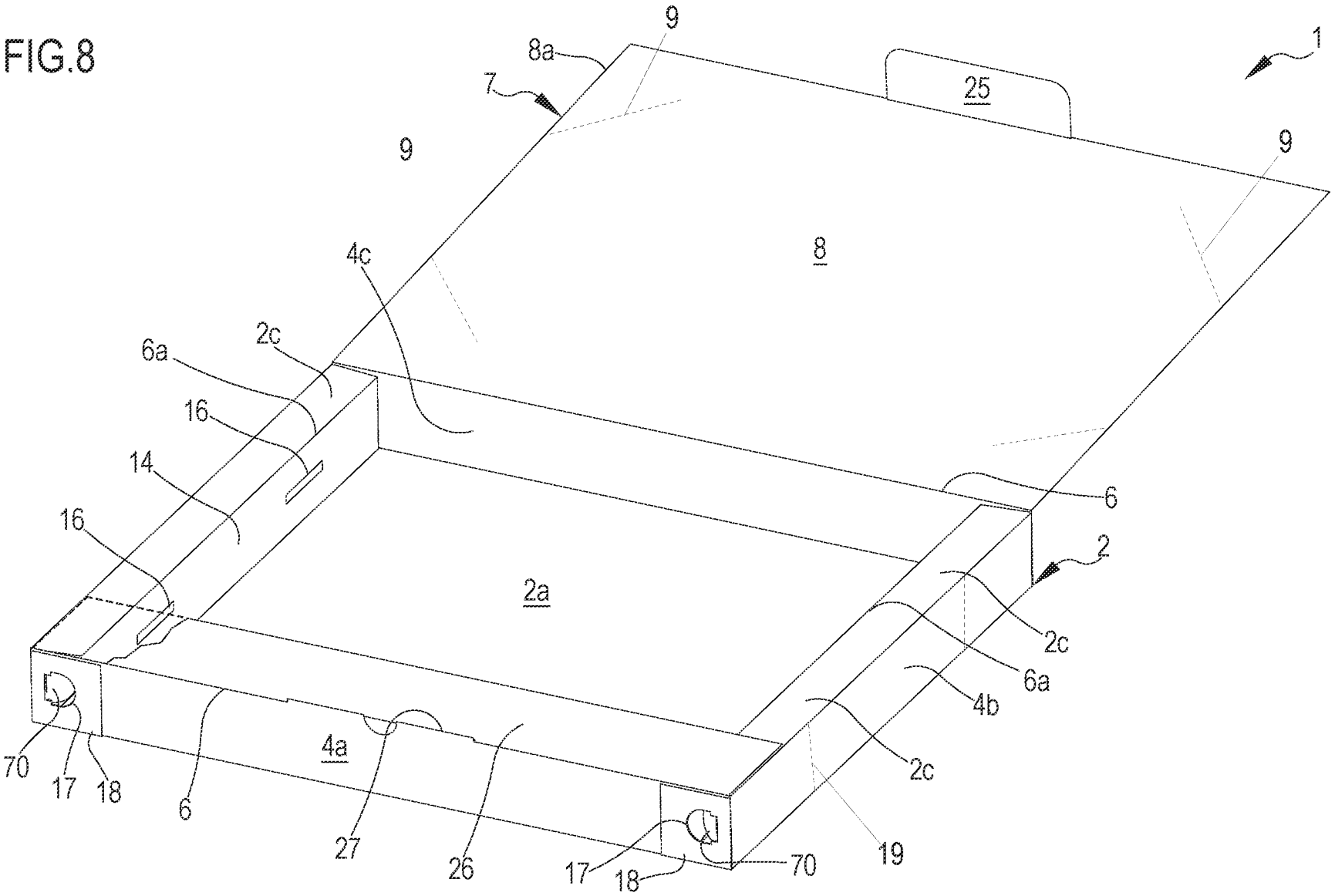
FIGS. 8 and 9 are perspective views of the container in accordance with the second embodiment.
Figure 12:
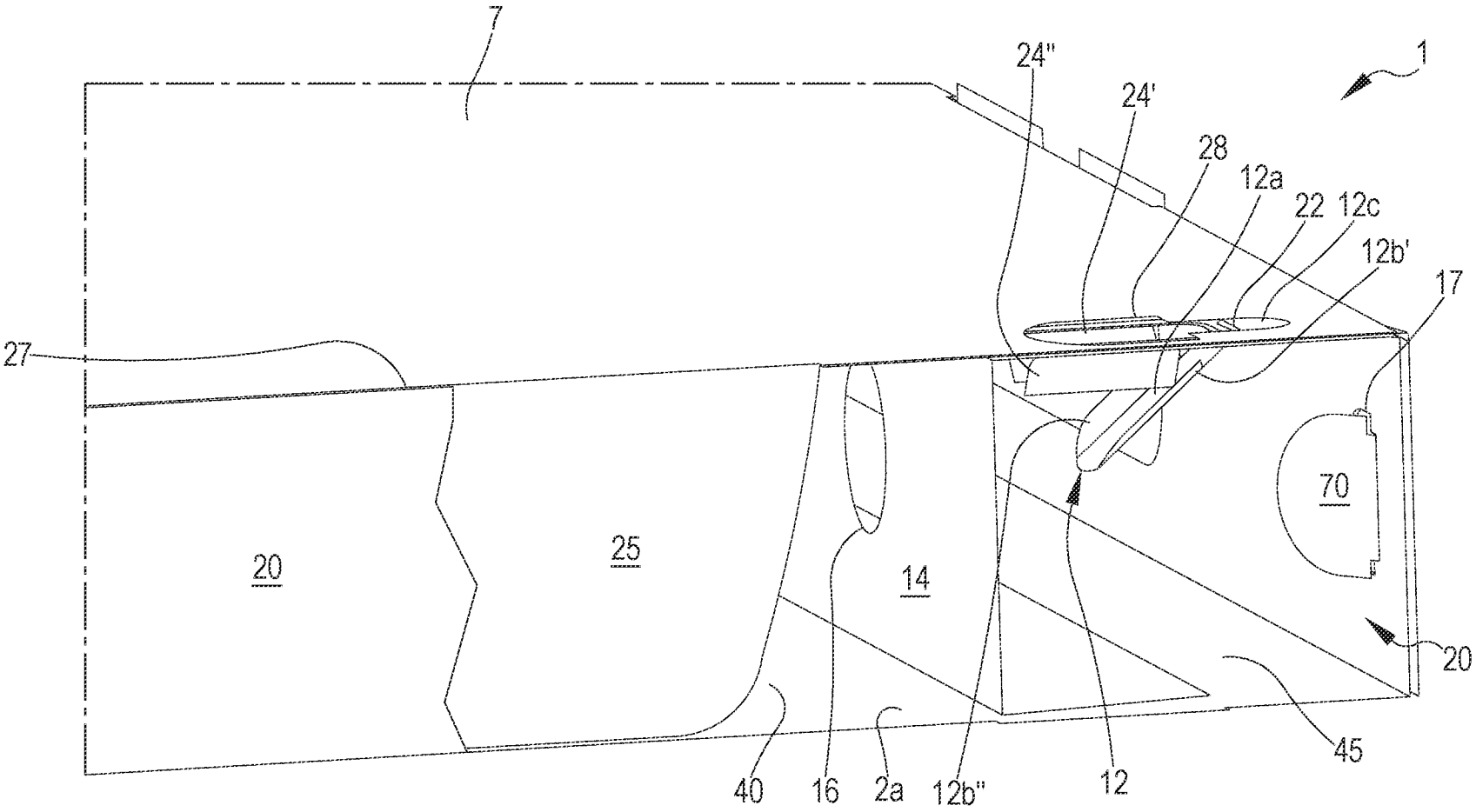
FIG. 12 is a cross section of a detail of the container in accordance with the third embodiment in which a first and a second coupling portion of the container are engaged with each other to define a locking condition.
Figure 14:
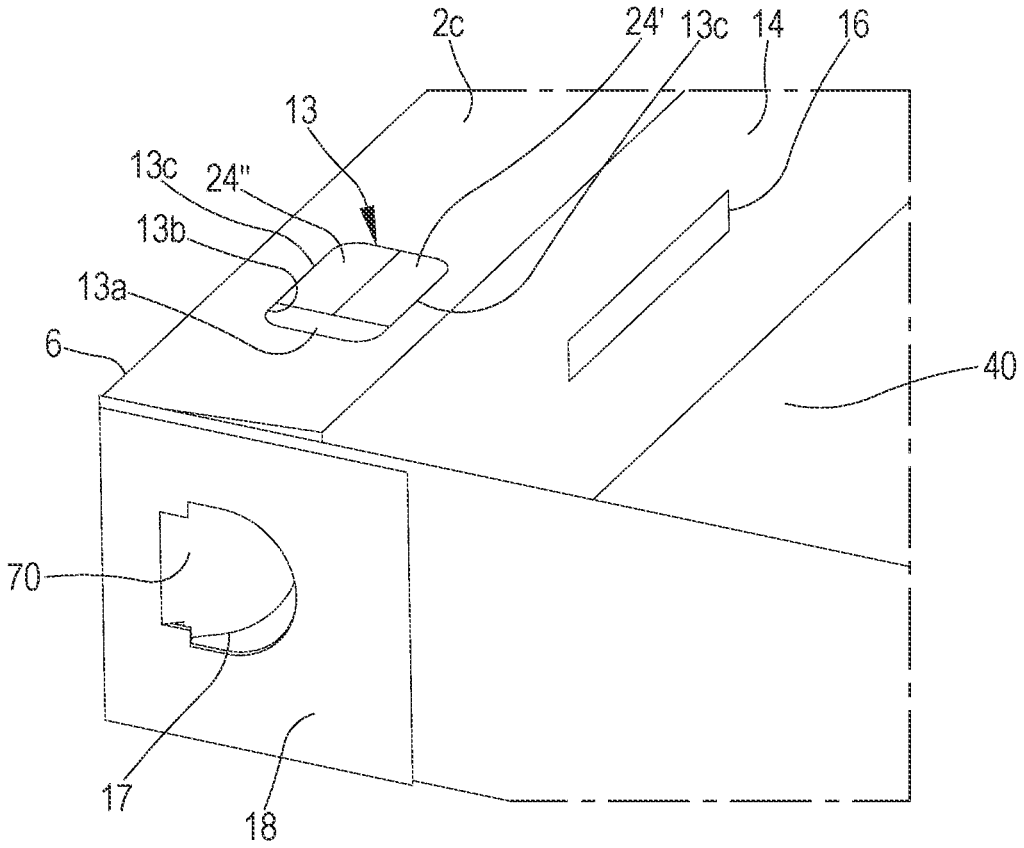
FIG. 14 is a detailed perspective view of the container in accordance with the fourth embodiment.
Figure 15:
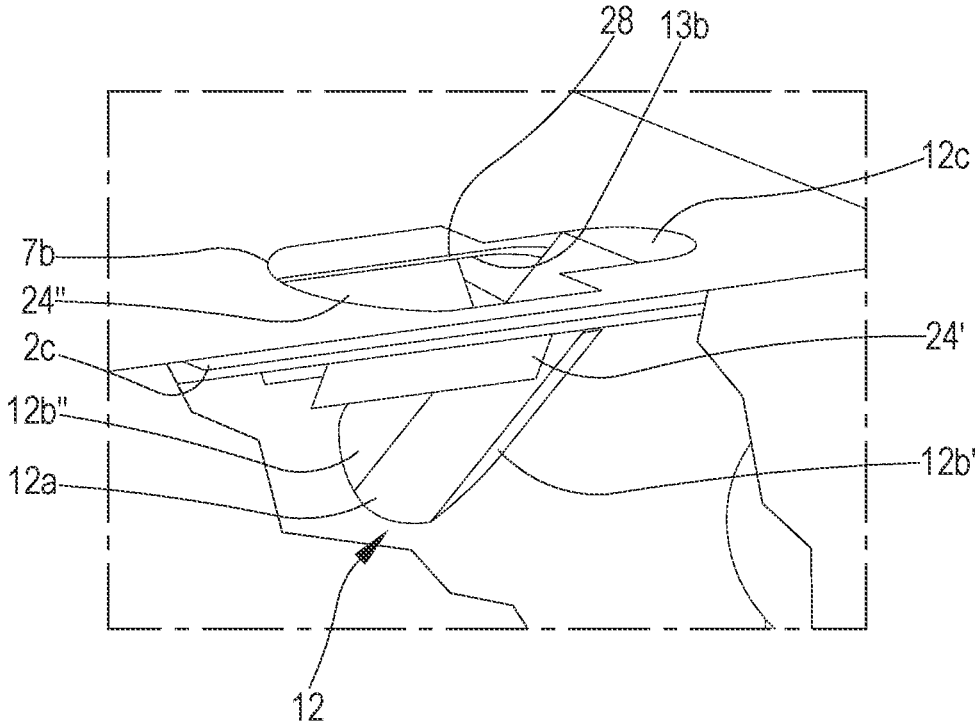
FIG. 15 is a cross section of a detail of the container in accordance with the fourth embodiment in which a first and a second coupling portion of the container are engaged with each other to define a locking condition.

As is for example shown in FIGS. 8, 12 and 14, the channel faces the air-vent opening 17, in a manner such to allow the air and/or vapor present within the second sub-chamber 45 to be expelled from the support through the air-vent opening 17. The separator 14 can then be interposed between the lateral wall 4 of the support on which the air-vent opening 17 is defined and the central zone of the support adapted to receive the product.

The separator 14 can comprise at least one through access 16 configured for placing in fluid communication the first and the second sub-chamber 40, 45: by means of the through access 16, the air and/or the vapor present within the first sub-chamber 40 are conveyed within the second sub-chamber 45 and expelled through the air-vent opening 17. The through access 16 can have a circular or polygonal conformation, with dimensions comprised between 20% and 90% of the width of the same separator 14, in a manner such to allow an effective transfer of fluid between the first and the second sub-chambers 40, 45 without compromising the structural strength of the separator 14. Each through access 16 is offset with respect to an air access opening 17, in a manner such to prevent a user from inserting a finger and/or a tool through the through access 16 and the air access opening 17 to contaminate the product placed in the central zone of the support. The separator 14 can further comprise a plurality of through accesses 16 that are equidistant from each and distributed for the entire length of the same separator 14, configured for maximizing the transfer of fluid between the first and the second sub-chamber 40, 45.

The support 2 can comprise a single separator 14 integrally joined to the first lateral wall 4*a*; alternatively, the support 2 can comprise a plurality of separators 14, respectively integrally joined to the first and to the second abutment flap 2*c*.

The support 2 can further comprise at least one intermediate flap 26 emerging from at least one section of the free edge 6 of the support 2 adjacent to the support flap 2*c*. In fact, the intermediate flap 26 faces the base 2*a* of the support, in a manner such to define a portion folded along the section of free edge 6 with which it is engaged and perimetrically delimiting the through opening 5. As shown in the enclosed figures, the intermediate flap 26 has a rectangular shape extended for the entire the free end section defined by the lateral wall with which it is engaged. With regard to the structure, the intermediate flap 26 has a limited extension along a direction facing the internal volume 3 of the support 2, in a manner such to maximize the extension of the through opening 5 and allow an easy insertion of the food product in the internal volume 3. In detail, the extension of the intermediate flap 26 along a direction entering the internal volume 3 can be comprised between 2 cm and 10 cm. The ratio between the extension of the intermediate flap 26 along the direction entering the internal volume 3 and the extension of the lateral wall with which it is engaged can be comprised between 0.06 and 0.3. Regarding size, the intermediate flap 26 is substantially identical to the abutment flap 2*c*. As is visible in the enclosed figures, the intermediate flap 26 is defined adjacent to the abutment flap 2*c*, being superimposed on the abutment flap 2*c* at a longitudinal end of the latter. The intermediate flap 26, in the closed condition of the container 1, can be then interposed between the same abutment flap 2*c* and the closure system 7.

The intermediate flap 26 can further have a through opening 28 with closed profile, arranged, at least in the closed condition of the closure system 7, facing the abutment flap 2*c*. The through opening 28 can be defined at a longitudinal end of the intermediate flap 26 superimposed on the abutment flap 2*c*. The through opening 28 is configured for allowing a first coupling portion 12 carried by the closure system to reach a second coupling portion 13 defined at the longitudinal end of the abutment flap 2*c* arranged within the intermediate flap 26.

The intermediate flap 26 can comprise a first and the second intermediate flap 26', 26" (FIGS. 2, 11 and 12) emerging respectively from sections of the free edge 6 defined by the second and by the fourth lateral wall 4*b*, 4*d*; first and second intermediate flaps 26', 26" are both superimposed on an abutment flap 2*c* defined at the first wall 4*a*. Alternatively, the support 2 can comprise a single intermediate flap 26 integrally joined to the first wall 4*a*, which is superimposed on respective terminal portions of the abutment flaps 2*c* carried by the second and by the fourth lateral wall 4*b*, 4*d*.

The support 2 can further comprise a slit 27 made following the definition of a notch on the same intermediate flap 26 and/or on the abutment flap 2*c*, configured for allowing the insertion of at least one connection tongue 25 within the internal volume 3 of the support 2. The slit 27 is defined in proximity to the free edge 6 and is extended parallel to the latter for a size comprised between 5% and 80% of the longitudinal extension from terminal portions of the lateral wall which defines the same free edge 6. In detail, in a first and a third embodiment of the invention, the slit 27 is extended for most of the longitudinal extension of the intermediate flap 26 on which it is defined. Vice versa, in accordance with the second and the fourth embodiment of the invention, the slit 27 is extended for a limited section of the intermediate edge 27 comprised between 10% and 40% of the longitudinal extension of the intermediate flap 26.

The support 2 is made of sheet material and obtained for example via folding. In a preferred but non-limiting embodiment of the invention, the support 2 is made of sheet material paper (paper or cardboard); in particular, the sheet material used has a basis weight comprised between 100 and 500 $g/m^2$, in particular comprised between 200 and 400 $g/m^2$.

As is visible in the enclosed figures, the container 1 comprises a closure system 7, also of sheet material, engaged at at least one section of the free edge 6 and movable, in particular via rotation, with respect to the support 2. In particular, the closure system 7 is configured for defining at least one closed condition in which the same closure system 7 prevents the communication between the internal volume 3 of the support 2 and the external environment and an open condition in which it allows a user to access the internal volume 3 of the support 2 (see for example FIGS. 2, 9, 10 and 12). In fact, the system 7 substantially represents a cover adapted to cooperate with the support 2 so as to manage the access to the internal volume 3. The closure system 7 is, in a non-limiting manner, integrally joined at the free end section 6 defined by the third wall 4*c*, being movable via rotation around the latter at least between the open and closed conditions. However, it is possible to arrange a closure system 7 that is separate and completely separable from the free edge 6, in fact defining a cover removably engageable with the support 2.

In more detail, the closure system 7 comprises at least one closure panel 8 of sheet material and engaged with at least one section of the free edge 6. In particular, the closure panel 8 has a conformation that is counter-shaped with respect to the free edge 6 in a manner such to allow, in the closed condition of the closure system 7, to entirely obstruct the passage opening 5 and prevent the access to the internal volume 3. In fact, in the closed condition of the closure system 7, the closure panel 8 is at least partly in contact with the abutment flap 2*c* and with the intermediate flap 26.

The closure panel 8 can also have at least one connection tongue 25 configured for being inserted, in the closed condition of the system 7, within the volume 3 of the support 2. The connection tongue 25 is integrally joined to the closure panel 8 and emerges from the latter starting from an external perimeter edge 8*a* delimiting the closure panel 8. The connection tongue 25 substantially represents an extension of the closure panel 8 adapted to be inserted, in the closed condition of the system 7, within the slit 27 of each intermediate flap 26. As is visible in the enclosed figures, also the connection tongue 25 is defined from a flat body of sheet material having, as a non-limiting example, rectangular shape. In the closed condition of the closure system 7, the connection tongue 25 directly faces, in particular contacts, a part of a lateral wall 4 of the support 2, extended parallel to the latter.

The connection tongue 25 is also movable via rotation with respect to the closure panel 8 around a section of the external perimeter edge 8*a*. As is visible for example in FIGS. 2, 8, 9 and 11 the connection tongue 25, in the closed condition of the closure system 7, is configured for defining, according to a transverse section and in cooperation with the closure panel 8, a substantially "L" shape: in such condition the connection tongue 25 is substantially extended parallel to a lateral wall 4 of the support 2.

Figure 2:
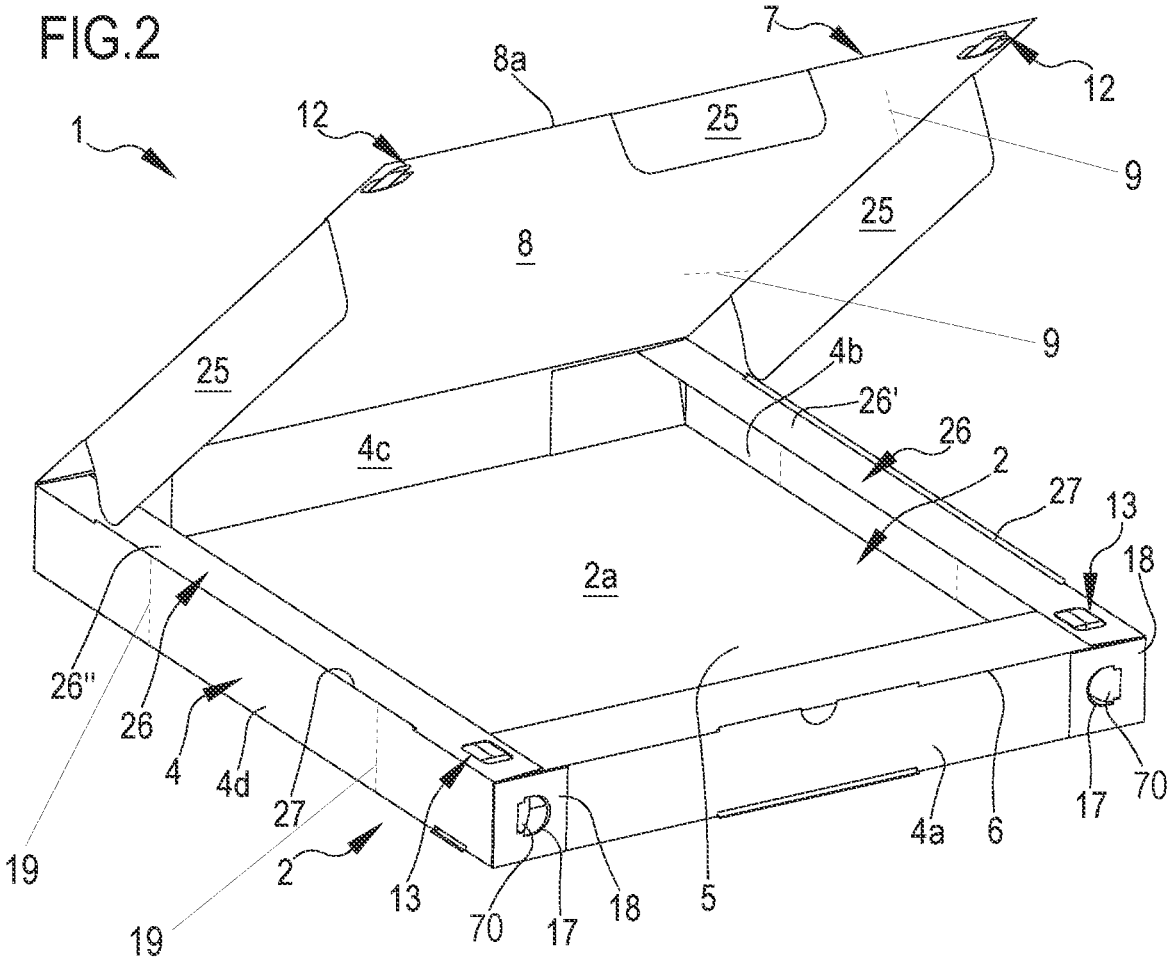
FIG. 2 is a perspective view of the container in accordance with the first embodiment, arranged in an open condition.
Figure 9:
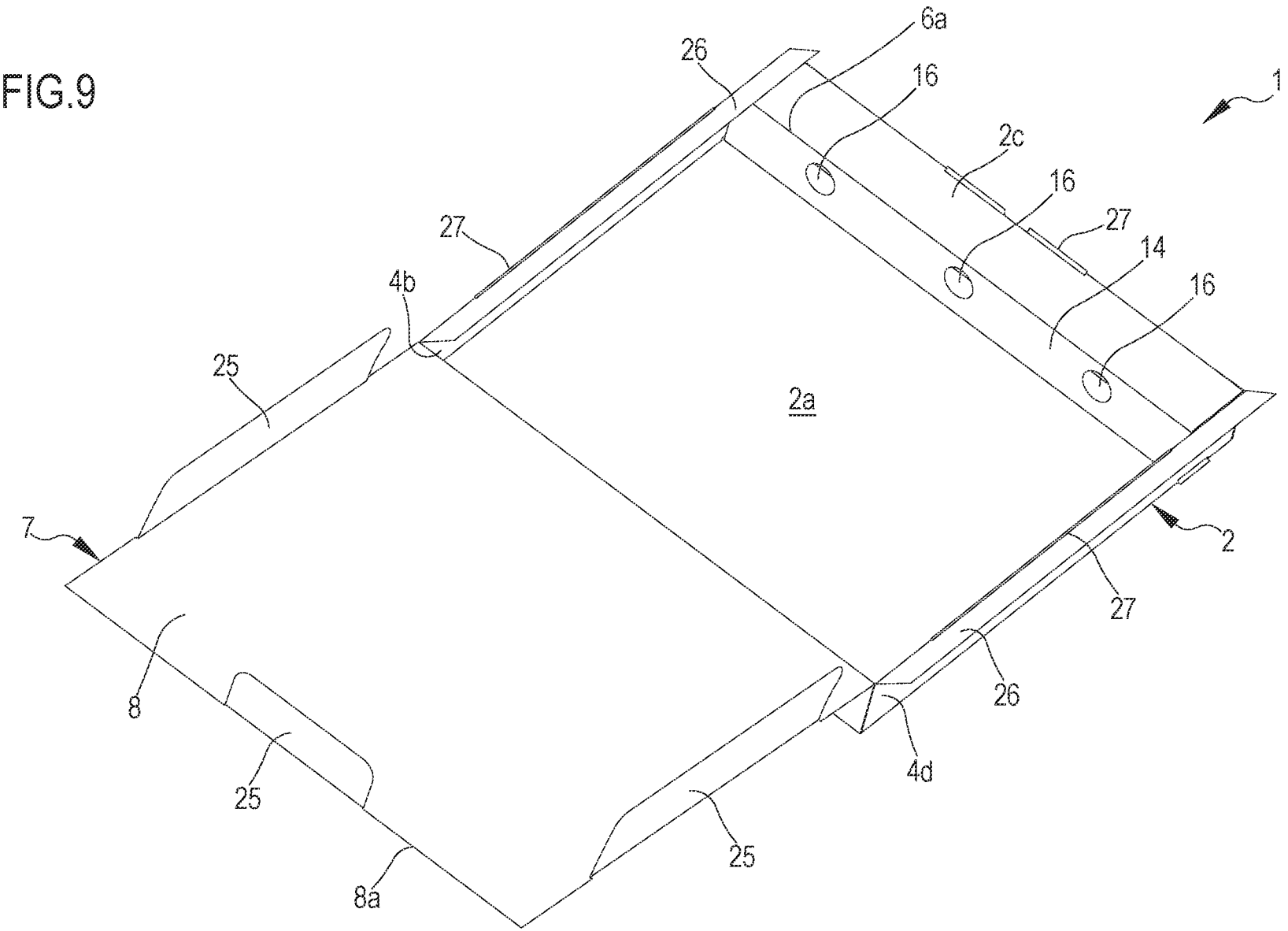

As is visible in FIGS. 2, 9 and 12, the closure panel 8 can have three connection portions 25, each of which, in the closed condition of the closure system 7, is respectively insertingly within a slit 27 defined on the first and on the second intermediate flap 26', 26" and on the abutment flap 2*c*. Vice versa, in the embodiment of the container of FIG. 8, the closure panel 8 can have a single connection portion 25 insertable within a respective slit 27 defined on the intermediate flap 26 integrally joined to the first lateral wall 4*a*.

In a preferred but non-limiting embodiment of the invention, the closure system 7 is at least partly made, in particular entirely, of sheet material paper (paper, cardboard or corrugated cardboard); the sheet material used has a basis weight comprised between 100 and 500 g/m$^2$. Optionally, the sheet material paper used for attaining the closure system 7 is equivalent to the sheet material used for attaining the support 2, in particular they are both obtained starting from only a single sheet of paper material.

As is visible in the enclosed figures, the container 1 comprises at least one first coupling portion 12, carried by the closure system 7, and at least one second coupling portion 13 defined on at least one abutment flap 2*c*. In particular, the first coupling portion 12 is configured for being stably engaged with an undercut portion 13*b* of the second coupling portion 13 in a manner such to define a locking condition.

The first coupling portion 12 is engageable with the second coupling portion 13 following the arrangement of the closure system 7 in contact with the abutment flap 2*c* and with the intermediate flap 26, in a manner such to arrange the same first coupling portion 12 in superimposition on the second coupling portion 13 and on the display opening 28. In fact it should be observed that the attainment of the engagement between the first and second coupling portions 12, 13 is only reached following the alignment of the latter along a direction orthogonal to the base 2*a* of the support 2.

The first coupling portion 12 is attained on the closure system 7 following the definition on the latter of a notch adapted to define a through seat 7*a* delimited by a perimeter edge with closed profile which is arranged within the external perimeter edge 8*a* of the closure portion. Consequently, the first coupling portion 12 is defined arranged within the through seat 7*a* and within the external perimeter edge 8*a*. However, it is possible to attain a first coupling portion 12 emerging starting from the external perimeter edge 8*a* of the closure portion 8.

The first coupling portion 12 comprises a central body 12*a* and a base body 12*c* integrally joined to the central body by means of a folding edge 22: the central body 12*a* is movable with respect to the base body 12*c* around the folding edge 22.

The central body 12*a* and in general the first coupling portion 12, can thus be movable around the folding edge 22 at least between a first and a second operating position. In the first operating position, the first coupling portion 12 is disengaged from the second coupling portion 13, at least partly facing a through pocket 13*a* of the second coupling portion 13. In the second operating position, the first coupling portion 12 is arranged in the internal volume 3 of the support, engaging with an undercut portion 13*b* of the same second coupling portion 13. The central body 12*a* has a surface size smaller than a passage area defined by the through pocket 13*a* of the second coupling portion 13, which is sufficiently small in order to allow the same central body 12*a* to insertingly pass through the through pocket 13*a*, i.e. allow the passage of the first coupling portion 12 from the first to the second operating position.

The first coupling portion 12 can further comprise at least one tab 12*b* emerging from the central body 12*a* starting from a folding edge 21. The tab 12*b* can be movable via rotation around the folding edge 21 from a position in which it lies parallel to the central body 12*a*, to a position in which it is arranged transverse to the latter, in which it is configured for being engaged with the undercut portion 13*a* of the second coupling portion 13. In particular, the tab 12*b* lies parallel to the central body 12*a* at least in the first operating position of the first coupling portion 12; vice versa, in the second operating position of the first coupling portion 12, the tab 12*b* defines, in cooperation with the central body 12*a*, a portion folded having a substantially "L" shape. In detail, the tab 12*b* is, in the closed condition of the closure system 7 and in the first operating position of the first coupling portion 12, facing the undercut portion 13*b* of the second coupling portion 13. As is for example shown in FIG. 4, the tab 12*b*, during the passage between the first and the second operating position, is configured for being folded with respect to the central body 12*a* in order to allow the insertion of at least part of the latter and of the tab 12*b* within the through pocket 13*a* of the second coupling portion 13. As is for example visible in FIGS. 5 and 12, the first coupling portion 12 in the second operating position of the latter, is entirely arranged in the internal volume 3 of the support 2 and in particular within the second sub-chamber 45.

The tab 12*b* then defines a respective undercut portion of the first coupling portion which, in the second operating position, faces the undercut portion 13*b* of the second coupling portion 13 and is configured for being engaged with the latter in order to define the locking condition.

As shown in the enclosed figures, the tab 12*b* can comprise a first and a second tab 12*b*', 12*b*" integrally joined to the central body 12*a* at respective folding edges 21 that are opposite each other. The first and second tabs 12*b*', 12*b*" are then configured, during the passage of the first coupling portion 12 from the first to the second operating position, in order to be folded with respect to the central body 12*a* in a manner such to define a substantially "C" or "U" shape having a concavity facing the closure system 7.

The container 1 can comprise two first coupling portions 12 defined at respective corner portions of the closure panel 8 arranged on the opposite side with respect to the free edge 6. In more detail, the first coupling portions 12 are configured for being engaged with respective second coupling portions 13 defined on the abutment flap 2*c* directly connected to the first lateral wall 4*a*.

Furthermore, the container 1 can comprise a pair of first coupling portions 12 thereof defined along a first perimeter portion of the closure panel 8, respectively engageable with second coupling portions 13 defined on the first abutment flap; the container 1 can also comprise a second pair of first coupling portions 12 defined along a second perimeter portion of the closure panel 8, opposite the first perimeter portion and configured for being engaged with respective second coupling portions 13 defined on the second abutment flap. It is also observed that the pairs of first coupling portions are arranged at a predetermined distance from each other, configured for effectively preventing a user from lifting the closure panel 8. In particular, the distance between a pair of first coupling portions 12 is comprised between 15 cm and 30 cm.

The container 1 comprises at least one second coupling portion 13 defined on the abutment flap 2*c*. In detail, the second coupling portion 13 comprises a through pocket 13*a* delimited by a perimeter edge and at least partially by a contrast portion 30. In fact, the through pocket 13*a* defines an opening configured for allowing the insertion of the first coupling portion 12 within the internal volume 3 of the container.

The through pocket 13*a* is at least partly delimited by an undercut portion 13*b* which is configured for engaging the tabs 12*b* of the first coupling portion 12. The undercut portion 13*b* is configured in order to allow, during the passage of the first coupling portion 12 from the first to the second operating position, intercepting the tabs 12*b* and allowing the folding thereof with respect to the central body 12*a*. As mentioned above, the passage section delimited by the undercut portion 13*b* is greater than a surface size of the central body 12*a*, but smaller than the sum of respective surface sizes of the central body 12*a* and of the tabs 12*b*. The passage section delimited by the undercut portion 13*b* thus sized allows the tabs 12*b* to be intercepted by the same undercut portion 13*b*, allowing the folding thereof on the central body 12*a* and the consequent engagement with the latter.

The second coupling portion 13 can also comprise at least one locking tab 24 emerging from the undercut portion 13*b* starting from a respective folding edge 13*c*, configured for at least partially obstructing the through pocket 13*a* in the second operating position of the first coupling portion. In fact, also the locking tab 24 is movable via rotation around the folding edge 13*c* at least between a flat position and a tilted position, by means of the thrust of the first coupling portion 12 exerted on the same locking tab 24 during the passage from the first to the second operating position. In particular, in the first closed condition of the closure system 7 and at least in the first operating position of the first coupling portion 12, the locking tab 24 is in the flat position, in which substantially it lies parallel to the abutment flap 2*c*. Vice versa, during the passage of the first coupling portion 12 from the first to the second operating position, the locking tab 24 is in the tilted position, in which it lies transverse to the abutment flap 2*c*. In the latter position, the locking tab 24 is folded with respect to the undercut portion 13*b* of the second coupling portion 13 at least partly in the internal volume 3 of the support 2, in a manner such to at least partially allow the insertion of the first coupling portion 12 through the through pocket 13*a* and be stably constrained with the tabs 12*b*. In other words, the locking tab 24, in the tilted position, is substantially interposed between the through pocket 13*a* of the second coupling portion 13 and at least one part of the first coupling portion 23 arranged in the internal volume 3 of the support 2.

It should be observed that the locking tab 24, in the tilted position, engages the tab 12*b* of the first coupling portion and prevents the latter from being moved towards a direction exiting the through pocket 13*a*.

Figure 3:
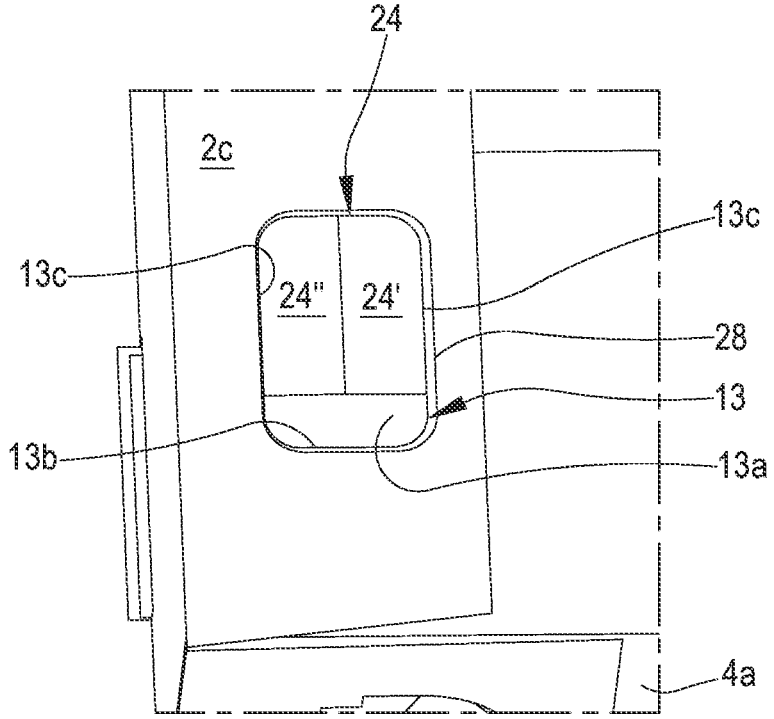
FIG. 3 is a top view of a second coupling portion of the container in accordance with the present invention.
Figure 6:
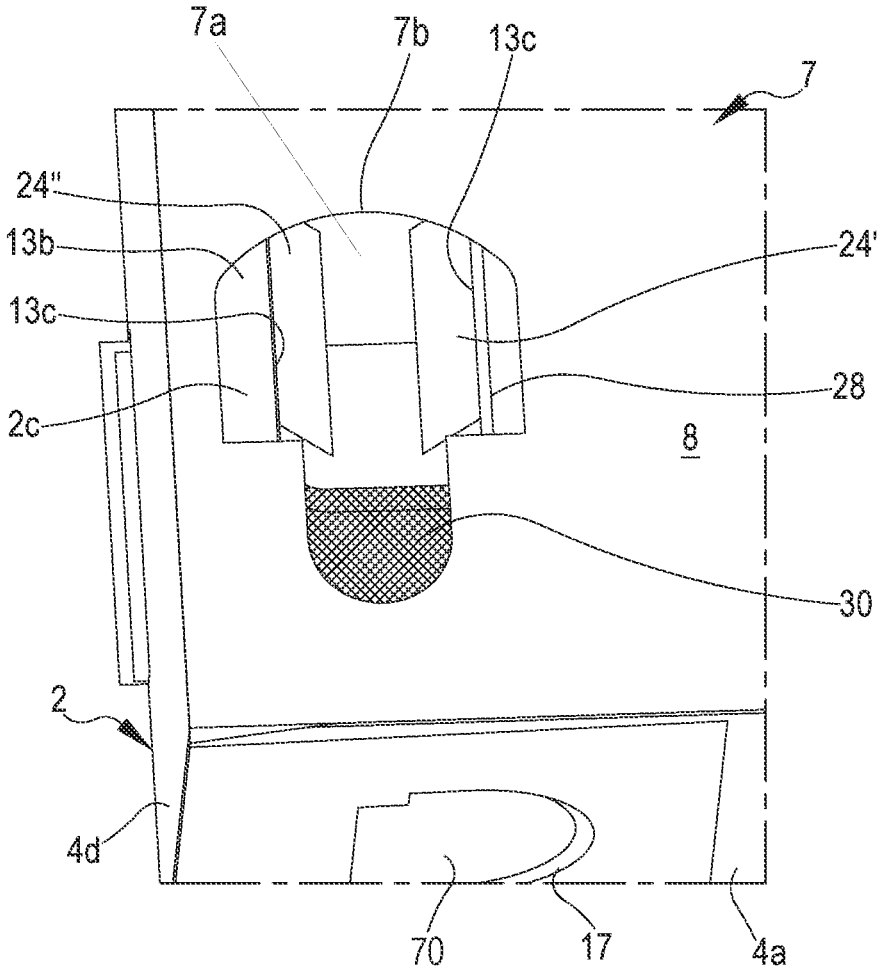
FIG. 6 is a detailed top view of a container in accordance with the present invention following a first open condition of the container.

The locking tab 24 can also comprise a first and a second locking tab 24', 24" respectively engaged with opposite portions of the perimeter edge of the through pocket 13*a*. In detail, the first and second locking tabs 24', 24" are engaged with sections of the perimeter edge that are opposite each other, both configured for at least partially obstructing the through pocket 13*a*. The first and second locking tabs are engaged with the perimeter edge at respective folding edges, around which they are movable via rotation between the flat position in which they are parallel to and abutted against each other (FIG. 3), and the tilted position in which they are relatively tilted and spaced from each other (FIG. 6). It should be observed that the first and second locking tabs 24', 24" are also configured for being constrained respectively with the first and second locking tabs 12*b*', 12*b*', preventing the exit of the latter from the through pocket 13*a*. The locking tabs 24 thus prevent a user from accessing the first coupling portion 12 and disengaging it from the second coupling portion 13.

The container 1 can comprise a pair of second coupling portions 13 defined at corner portions of the abutment flap 2*c* defined at the second and of the fourth lateral wall 4*c*, 4*d*. Furthermore, the container 1 comprises a first pair of second coupling portions 13 defined along the first abutment flap, as well as a second pair of second coupling portions 13 defined on the second abutment flap; the pairs of second coupling portions 13 are arranged at a predetermined distance from each other, configured for effectively preventing a user from lifting the closure panel 8. In particular, the distance between a pair of second coupling portions is comprised between 15 cm and 30 cm.

As mentioned above, the first and second coupling portions 12, 13, in the second operating position of the first coupling portion 12, are configured for defining a locking condition of the container in which said first and second coupling portions 12, 13 are stably engaged with each other in order to oppose the passage of the closure system 7 from the closed condition to the open one.

The first coupling portion 12 comprises a removable portion configured for being separated from the closure system 7 during a first open condition of the container following the locking condition in order to provide evidence of a tampering of the container 1. The first coupling portion 12 is carried by the closure system 7; in detail, the first coupling portion 12 is engaged with the closure system 7 by means of a weakening portion 23 configured for being broken, following the definition of the locking condition, during the passage of the closure system 7 from the first closed condition to the first open condition. In other words, the removable portion defined by at least one part of the first coupling portion 12 is integrally joined to the closure system 7 by means of a connection flap having a plurality of notches adapted to allow the tearing (optionally facilitated) of the connection flap: the notched connection flap defines the weakening portion adapted to connect the removable portion (the first coupling portion 12) to the closure system 7. In fact, the removable portion defined by said first coupling portion 12 is engaged with the closure system 7 only by means of said weakening portion 23; the weakening portion 23 is configured for allowing a facilitated tearing of the first coupling portion 12 in a manner such that, even following a slight stress of the first coupling portion 12, the same weakening portion 23 can be broken and allow the separation of the first coupling portion 12, thus giving proof of an attempted tampering of the container 1.

Figure 4:
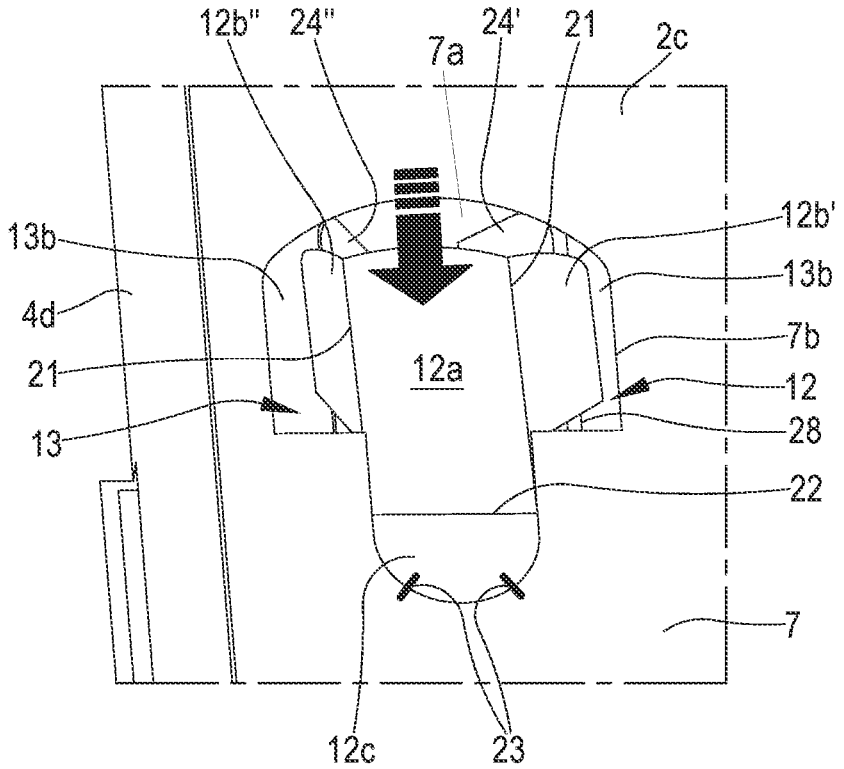
FIG. 4 is a schematic view of a first and a second coupling portion of the container in accordance with the present invention, during a passage condition between a first and a second operating position, in which in the second operating position, said first and second coupling portions are engaged with each other.

As is for example shown in FIG. 4, the first coupling portion 12 can be at least partly engaged with the closure system 7 at a plurality of weakening portions 23, the latter configured for being broken following the verification of a first open condition of the container in a manner such to define the removable portion. In fact, the first coupling portion 12 is only engaged with the closure system 7 at the weakening portions 23, entirely defining the removable portion. In other words, the entire first coupling portion 12 is configured for being separated from the closure system 7, giving proof to a user of tampering of the container.

Illustrated in a non-limiting manner in the enclosed figures, a first coupling portion 12 comprising a base body 12*c* engaged with the closure system 7 at the perimeter edge of the through seat 7*a*, by means of the weakening portion 23. The central body 12*a* is engaged with the base body 12*c* by means of a folding edge 22 that is separate and spaced from the weakening portions 23: the folding edge 22 allows the rotation of the central body 12*a* in an independent manner with respect to the base body 12*c*. In fact, arranging a folding edge 22 spaced from the weakening portions 23 allows preventing the accidental breakage of the latter in step of folding of the first coupling portion 12 engaging with the second coupling portion 13.

Figure 5:
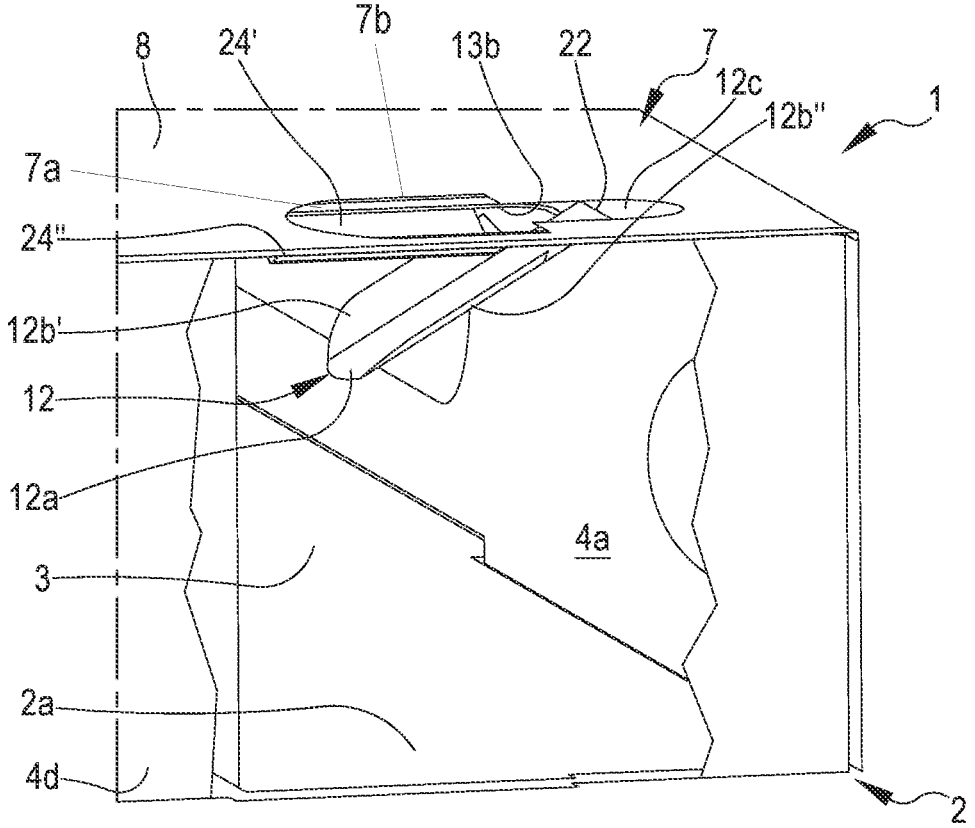
FIG. 5 is a side view in cross section of the container of FIG. 2, during a locking condition.

In fact, the base body 12*c* represents the element of the first coupling portion 12 connected to the closure system 7 by means of one or more weakened portions; the central body 12*a*, together with the at least one tab 12*b*, are integrally joined to the base body 12*c* and are foldable within the volume 3 of the container in order to define the locking condition. As shown for example in FIGS. 4 and 5, the base body 12*c* is configured for remaining, both in the first and in the second operating position of the first coupling portion 12, outside the internal volume 3 while the central body 12*a* and the at least one tab 12*b* are foldable with respect to said base body 12*c* during the passage from the first to the second operating position (FIG. 4) up to reaching a position inside the volume 3 (FIG. 5). The at least one tab 12*b* is foldable with respect to the central body 12*a* around the folding edge 21 extended transversely to the folding edge 22 of the central body 12*a*, separate and spaced from the same folding edge 22. In the FIG. 4, the step of folding of the first coupling portion 12 within the internal volume 3 is in fact visible, during which the tabs 12*b*', 12*b*" are folded around the edge 21 in order to allow the passage of the central body 12*a* and of the same tabs from the through pocket 13*a*; in such step, the central body 12*a* and the tabs are also folded with respect to the base body 12*c* around the folding edge 22.

Once the central body 12*a* and the tabs 12*b* have passed through the pocket 13*a* and are then arranged in the internal volume 3, the tabs are configured for being extended and stably engaged with the undercut portion 13*b* delimiting the through pocket 13*a* in order to lock the first coupling portion 12 within the volume 3.

During a first open condition of the closure system 7, the first coupling portion 12 is configured for being separated (due to the presence of the weakened portion 23) from the same closure system 7 and be deposited within the second sub-chamber 45. The first coupling portion 12 thus removed can give evidence of a tampering of the container that took place, without coming into contact with the first sub-chamber 40 and in particular, with the food product contained therein.

As shown in FIG. 6, the second coupling portion 13 can further comprise a contrast portion 30 defined on the abutment flap 2*c* and/or on the intermediate flap 26 and arranged, during a first closed condition 7 of the container, below the exposed surface of the removable portion, in particular below the base body 12*c*. As shown in FIG. 6, the contrast portion 30 defines an indicator visible through the through seat 7*a* of the closure system 7, configured for giving evidence of tampering of the container that occurred following the first open condition of the closure system 7. The contrast portion 30 can also comprise a signaling surface that is visibly different with respect to the abutment flap 2*c* and/or to the intermediate flap 26, configured for rendering the occurrence of the first open condition of the container even more evident to a user.

In fact, as shown in FIG. 6, the absence of the first removable portion 12 torn following the first open condition of the container 1 allows uncovering and rendering visible the contrast portion, which can visually signal (indicate) the absence of the first coupling portion 12, thus giving a user the possibility to quickly notice an attempt of tampering of the container 1.

As is visible in the enclosed figures, at least one between the support 2 and the closure system 7 can comprise at least one tear portion 9, 19 configured for allowing the breakage of said support 2 and/or closure system 7 during an attempt to open the container 1 itself when this is arranged in the locking condition.

Illustrated as a non-limiting example in the enclosed figures is the support 2 comprising at least one tear portion 19 defined on at least the lateral wall of the support 2, in particular defined on the second and fourth lateral wall 4*b*, 4*d*. In detail, at least one of said lateral walls of the support can comprise a plurality of tear portions 19 each defined by one or more aligned notches adapted to define a weakened portion of the lateral wall. Such notches can for example be extended starting from the base 2*a* up to at the free edge 6 (FIG. 6). In detail, each notch 19 can connect the base 2*a* with the slit 27 of the support adapted to receive the tongue 25 of the closure system. Such notches 19 are spaced and separated from the second coupling portion defined on the support 2 itself: the second coupling portions 13 are in fact placed at corner portions while the notches are arranged on the lateral walls of the support at a distance from the corner portions.

In the enclosed figures, also the closure system 7 comprises, in a non-limiting manner, at least one tear portion 9, separate and spaced from the removable portion (i.e. separate and spaced from each first coupling portion): each tear portion 9 of the closure system 7 comprises at least one notch, optionally a plurality of notches aligned along a predetermined trajectory and placed one after the other, defined on the closure portion 8 and extended substantially starting from the perimeter edge of said closure portion. The closure system 7 can comprise a plurality of tear portions 9 configured for allowing the breakage of the closure system 7 itself during an attempt of access of a user in the locking condition of the container. Illustrated in the enclosed figures, in a non-limiting manner, is a closure system 7 comprising four tear portions 9 arranged, in pairs, at opposite sides of the closure system 7.

In fact, each tear portion 9, 19 is positioned at a distance from the first and second coupling portions 12, 13, in particular at possible opening/access zones of the container. In the event in which a user wished in some manner to bypass the first and second coupling portions (i.e. attempt to open the container without stressing said first and second coupling portions 12, 13 and hence without causing the breakage of the removable portion), this would certainly cause an excessive stress of the support and/or of the closure system which would lead to a breakage of at least one of the tear portions 9, 19. In this manner, the tear portions 9, 19 are capable of giving evidence of an attempt of tampering of the container caused by an attempt to access inside the internal volume of the container without carrying out the normal opening of the same.

Process For Making the Container 1

Also forming the object of the present invention is a process for attaining a container 1 in accordance with the above-reported description and/or with any one of the enclosed claims.

The process provides for the arrangement of the support 2 which, as described above, is made of sheet material, optionally paper. In particular, such step provides for the arrangement of at least one first blank 50 of flat sheet material, comprising at least one central sheet 51 having a substantially quadrilateral, optionally square shape, at which at least one first lateral sheet 52 integrally joined to the central sheet 51 is engaged and emerging from the latter starting from the perimeter edge. In fact, the blank comprises a plurality of first lateral sheets 52 emerging for an entire perimeter edge of the central sheet 51.

The process can also comprise a step of folding of each first lateral sheet 52 with respect to the central sheet 51 in a manner such that the latter defines the base 2*a* of the support 2, while the first lateral sheets 52 define the first, the second, the third and the fourth lateral wall 4*a*, 4*b*, 4*c*, 4*d* of the support.

The first blank 50 can comprise at least one junction sheet 56 integrally joined to the first lateral sheets 52 defining the second and the fourth lateral wall 4*b*, 4*d*, at the longitudinal ends of the latter. The process can comprise a step of notching the junction sheet 56 in a manner such to make an opening 56*a* defining at least one tongue 56*b*. The step of notch of the junction sheet allows defining the locking tongue 70.

Figure 7:
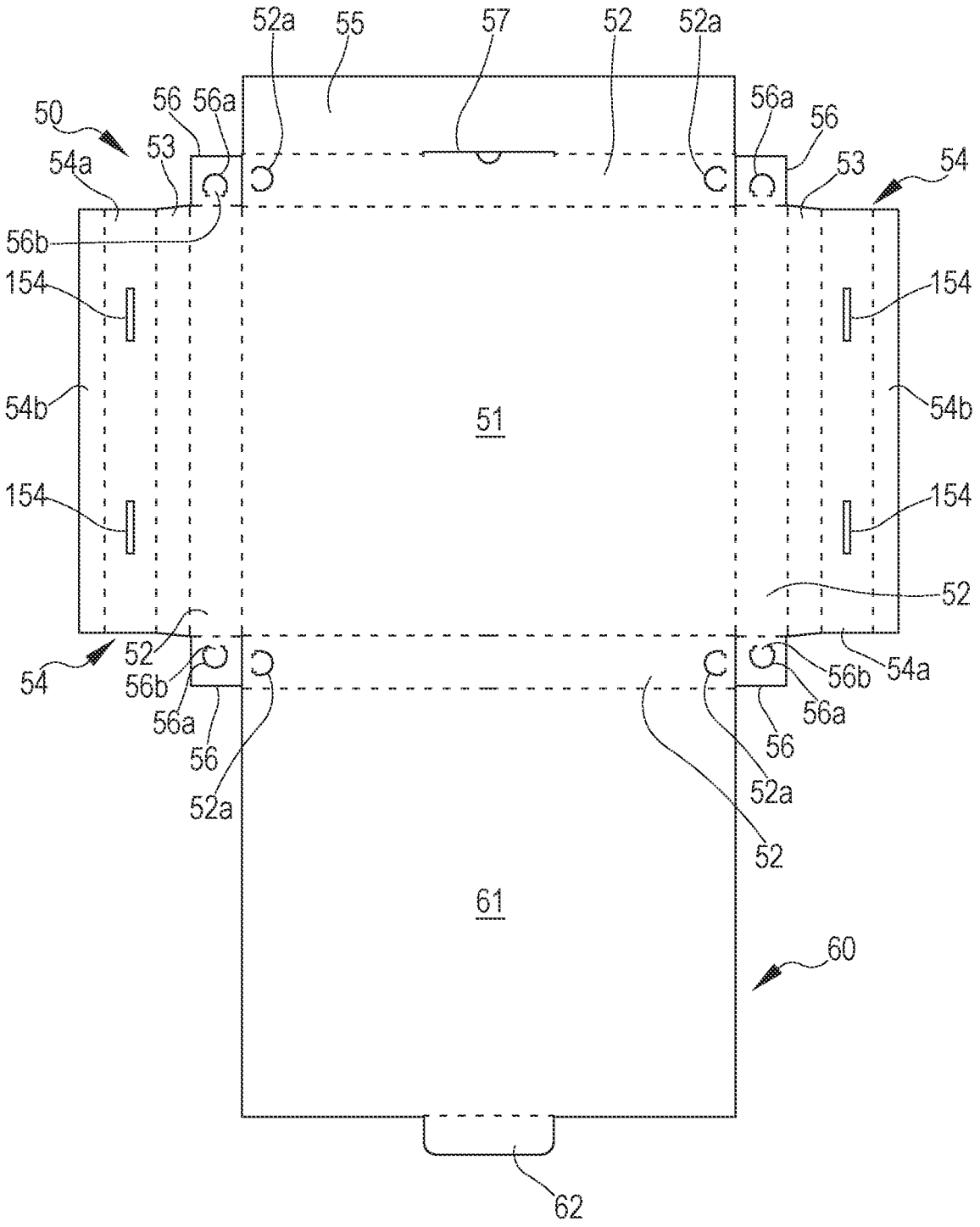
FIG. 7 shows a blank for attaining a second embodiment of a container in accordance with the present invention.
Figure 10:
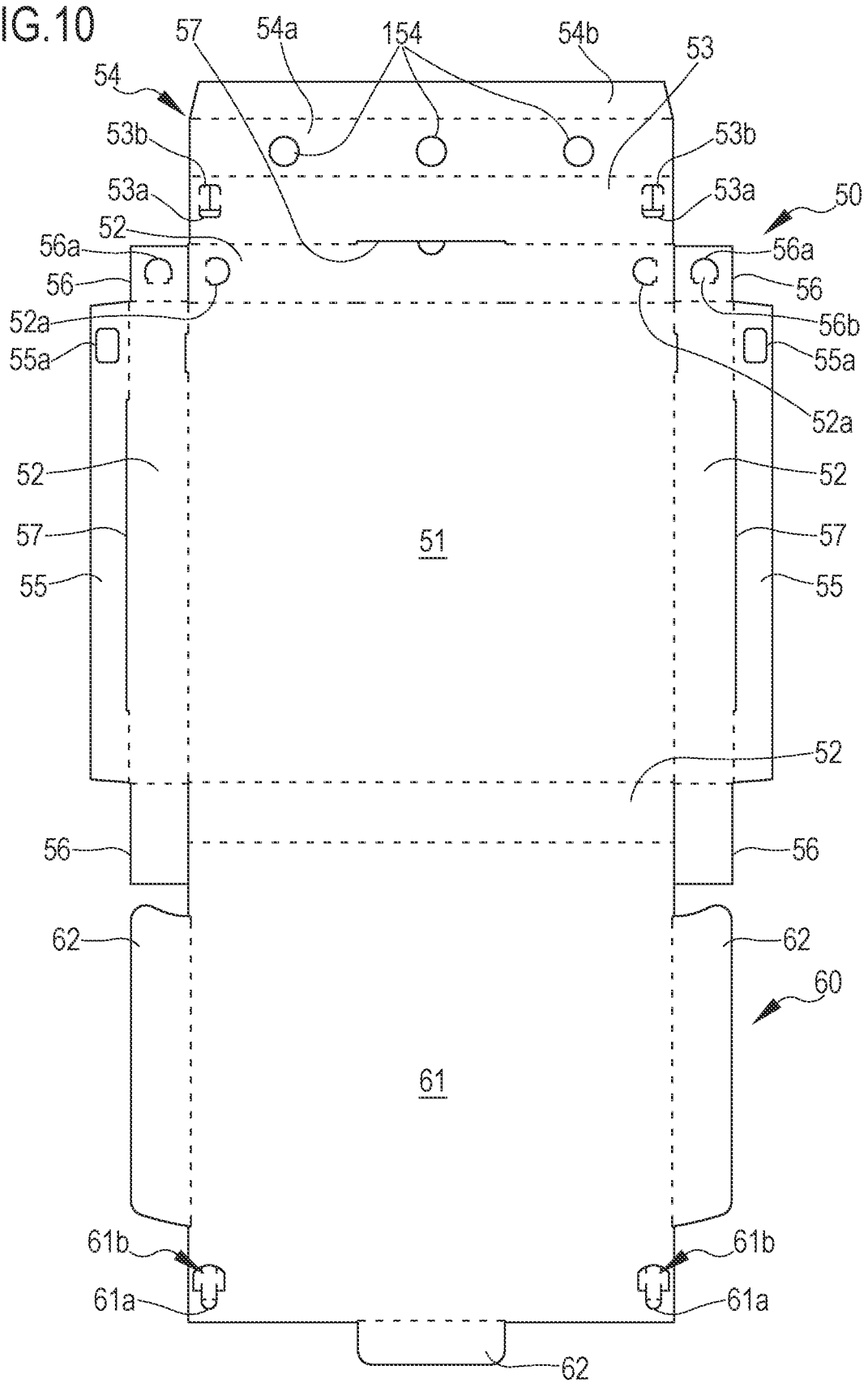
FIG. 10 shows a blank for attaining a third embodiment of a container in accordance with the present invention.
Figure 11:
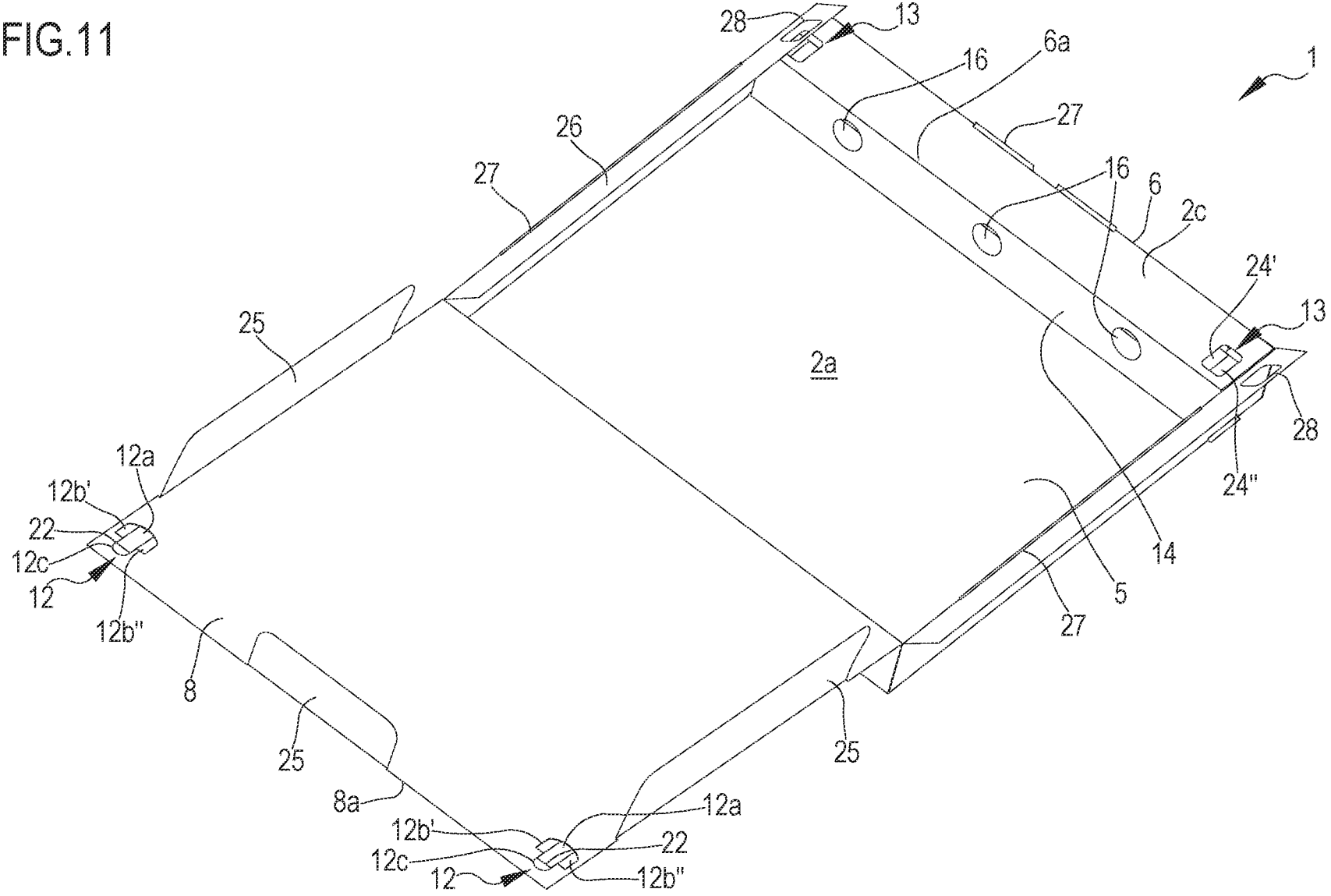
FIG. 11 is a perspective view of the container in accordance with the third embodiment.
Figure 13:
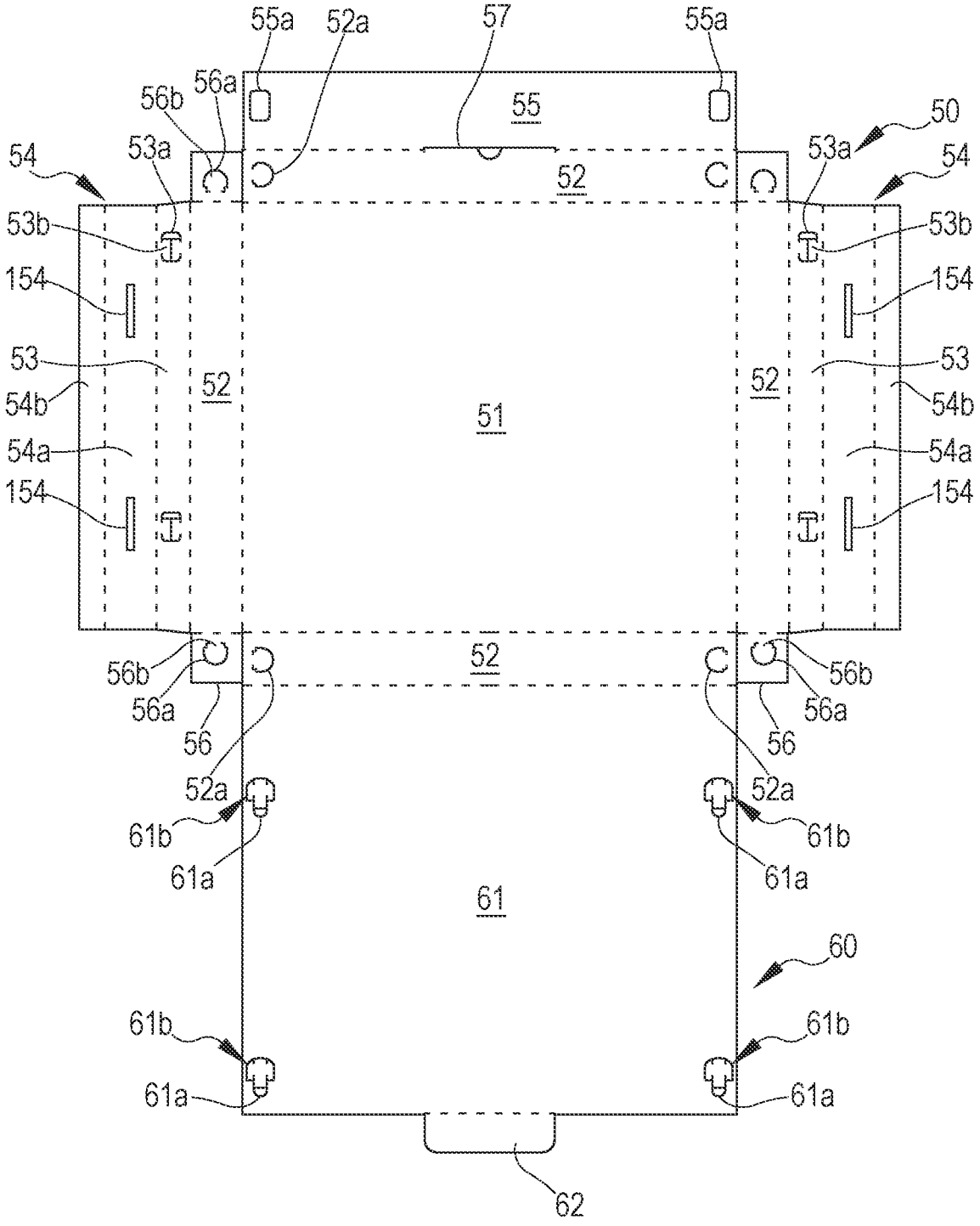
FIG. 13 shows a blank for attaining a fourth embodiment of a container in accordance with the present invention.

In particular, it should be observed that, in accordance with the first and the third embodiment of the blank 50 respectively shown in FIGS. 1 and 10, the latter step of notching the junction sheet 56 is only executed on the junction sheet 56 adjacent to the first lateral sheet 52 defining the first lateral wall 4*a*. Vice versa, in accordance with the second and the fourth embodiment of the blank 50 respectively shown in FIGS. 7 and 13, such notching step is executed on each terminal sheet 56.

The process further comprises a step of notching the first lateral sheet 52 defining the first lateral wall 4*a* and/or the first lateral sheet 52 defining the third lateral wall 4*c*, in a manner such to make at least one terminal opening 52*a* defining the air-vent opening 17. In particular, the process provides for the definition of the terminal opening 52*a* on said first lateral sheets 52 at the respective longitudinal ends adjacent to a tongue 56*b* of the terminal sheet 56.

The process can also comprise a step of folding the terminal sheet 56 superimposed on a first lateral sheet 52 adjacent to the latter, as well as a step of engaging the tongue 56*a* within the terminal openings 52*a*, in a manner such to reach the stable three-dimensional configuration of the support.

The blank 50 can also comprise a second lateral sheet 53 integrally joined to the first lateral sheet 52 on the side opposite the central sheet 51: the first lateral sheet 52 is thus interposed between said the central sheet 51 and the second lateral sheet 53. In particular, in accordance with the first and the third embodiment of the blank 50, the latter is integrally joined to the second sheet 52 defining the first lateral wall 4*a*. Vice versa, in accordance with the second and the fourth embodiment of the blank 50, the latter can comprise a plurality of third leaves 53, each of which integrally joined to the lateral sheets 52 defining the second and the fourth lateral wall 4*b*, 4*d*.

The process can also comprise the attainment of a through notch 53*a* on the second lateral sheet 53 in a manner such to define the second coupling portion 13 and, in particular, the first and second locking tabs 24', 24".

The process can further comprise a step of folding of each second sheet 53 with respect to the second lateral sheet with which they are engaged, in a manner such that the second lateral sheet 53 defines the abutment flap 2*c* of the support 2.

The blank 50 can also comprise a third lateral sheet 55 integrally joined to a first lateral sheet 52 with which the second lateral sheet 53 is not engaged: the first lateral sheet 52 is then interposed between the central sheet 51 and the third lateral sheet 55. The process can further comprise a step of notching the fourth lateral sheet 55 in a manner such to make a separator 57 defining the slit 27. Such notching step, in accordance with the first embodiment of the container shown in FIG. 1, can also be made on the second lateral sheet 52 interposed between the central sheet 51 and the second lateral sheet 53. The process can also comprise a step of notching the third sheet 55, making through openings 55*a*, which define the display openings 28. It should be observed that the process can provide for a further step of folding the third lateral sheet 55 with respect to the first sheet 52 with which it is engaged in a manner such to define the intermediate flap 26.

In accordance with the second, the third and the fourth embodiment of the container, the process comprises a perimeter blank 54 in turn comprising a first auxiliary sheet 54*a* integrally joined to the third sheet 53 on the side opposite the second sheet 52.

The blank 54 can further comprise a second auxiliary sheet 54*b* integrally joined to the first auxiliary sheet on the side opposite the third sheet 53. In other words, the first auxiliary sheet 54*a* can be interposed between the third sheet 53 and the second auxiliary sheet 54*b*. The process can then comprise a step of folding the first auxiliary sheet 54*a* with respect to the third sheet 53 in a manner such to define the separator 14, as well as a step of folding of the second auxiliary sheet 54*b* with respect to the first auxiliary sheet 51*a*. The process can then provide for a step of engaging the same second auxiliary sheet 54*b* with the central sheet 51 of the first blank, for example by means of gluing or mechanical interference, defining the first and the second sub-chamber 40, 45.

The process can also comprise a step of notching executed on the first auxiliary sheet 54*a* in a manner such to make at least one through opening 154 defining the through access 16 of the separator 14. In detail, such notching step can provide for defining a plurality of through openings 154 that are separate and spaced from each other, each of which defining a through access 16.

The process can further comprise the arrangement of a second blank 60 of sheet material, associable with the first blank 50. It should be observed that in the enclosed figures the second blank 60 is shown integrally joined to the first blank 50 to define a single flat blank. Nevertheless, it may be possible that the second blank 60 be separate and spaced from the first blank 50, in a manner such to substantially define a cover configured for being engaged with the latter.

The second blank 60 can be integrally joined to a second lateral sheet 52 defining the third lateral wall 4*c* of the support, in a manner such that said second lateral sheet 52 is interposed between a central sheet 61 of the second blank 60 and the central sheet 51 of the first blank 50. The second blank 60 then comprises the central sheet 61 and at least one peripheral sheet 62 integrally joined to the central sheet 61. In particular, the process comprises a step of folding of each peripheral sheet 62 with respect to the central sheet 61 in a manner such to define the connection tongue 25. The process can provide for a step of folding each peripheral sheet 62 with respect to the central sheet 61 of the second blank, in a manner such to allow the insertion of the same peripheral sheet within the separator 57.

In accordance with the first, the third and the fourth embodiment, the process comprises a step of notching the central sheet 61 of the second blank 60 in a manner such to make at least one notch 61*b* defining the first coupling portion 12. In particular, as shown in the enclosed figures, the process can provide for the execution of the latter step of notching the central sheet 61 of the second blank 60 in a manner such to make a plurality of first coupling portions 12.

Furthermore, the process can comprise a step of arranging at least one weakened section 61*a* defining the weakening sections 23 of the removable portion. In particular, the process provides for making a plurality of weakening sections at each notch 61*a*, defining a respective removable portion.

The process can also comprise a step of folding of the central sheet 61 of the second blank with respect to the first lateral sheet 52 with which it is engaged, in a manner such to allow the superimposition of the central sheets 51, 61 respectively of the first and of the second blank 50, 60.

It should also be observed that the process provides for a step of inserting each peripheral sheet within a respective separator 57. The latter step, in cooperation with the step of folding of the central sheet 61 of the second blank, allows achieving the closed condition of the closure system 7.

Closing Method

The present invention also relates to a method for closing a container 1 in accordance with the above-reported description and/or with any one of the enclosed claims. The method for closing the container 1 provides for arranging a container 1 in accordance with any one of the above-described embodiments.

The method for closing the container 1 comprises a step of arranging the closure system 7 in the closed condition of the closure system 7. In particular, such step provides for arranging the closure panel 8 in contact with the abutment flap 2*c* and/or the intermediate flap 26, in a manner such to at least partially obstruct the passage opening 5 of the support 2. It should be observed that in order to arrange the closure panel 8 in contact with the abutment flap 2*c* and/or the intermediate flap 26, it allows arranging each connection tongue 25 insertingly within a respective slit 27.

As is shown for example in FIG. 4, the closing method also provides for pushing, for example by means of a finger of a user, the first coupling portion 12 through the through pocket 13*a* of the second coupling portion 13, determining the rotation of the central body 13*a* with respect to the base body 13*c*, as well as the rotation of the first and of the second tab 12*b*', 12*b*" on the central body 13*a*.

Such step then provides for inserting the second coupling portion 12 thus folded in the internal volume 3 of the support engaging the undercut portion 13*b* of the second coupling portion 13.

It should be observed that the step of pushing the first coupling portion 12 through the through pocket 13*a* of the second coupling portion 13 further determines the movement of the first and of the second locking tab 24', 24" with respect to the abutment flap 2*c* towards a direction entering the through pocket 13*a*. The closing method can then provide for arranging the first and the second tab 12*b*', 12*b*" below the first and second locking tabs 24', 24" and engaging with the latter, in a manner such to reach the locking condition.

The closing method furthermore provides for repeating the execution of the steps of insertingly pushing the first coupling portion 12 within the through pocket 13*a* of the second coupling portion 13, as well as of the step of engaging the same first coupling portion with the first and second locking tabs 24', 24".

The invention claimed is:

1. A tamper-evident container for housing at least one product, said container comprising:

a support of sheet material defining an internal volume configured for housing at least one product, said support comprising:

at least one base;

at least one lateral wall emerging from the base and delimiting, in cooperation with the latter, the internal volume, wherein said at least one lateral wall defines, opposite the base, an outer edge;

at least one abutment flap emerging from at least one section of the outer edge and at least partly facing the base, wherein said at least one abutment flap at least partly delimits a passage opening configured for placing in communication the internal volume with the external environment;

at least one closure system, also of sheet material, movable with respect to the support at least between:

a closed condition of the container in which the closure system is configured for preventing the communication between the internal volume of the support and the external environment; and an open condition of the container in which the closure system is configured for allowing the communication between the internal volume and the external environment;

at least one first coupling portion carried by the closure system;

at least one second coupling portion defined on the at least one abutment flap, wherein said second coupling portion comprises at least one through pocket at least partly delimited by at least one undercut portion, wherein, at least during a first closed condition of the container, the first coupling portion is movable at least between:

a first operating position in which the first coupling portion is disengaged from the second coupling portion; and a second operating position in which at least part of the first coupling portion passes through the through pocket and is arranged in the internal volume, engaging the undercut portion;

wherein the first and second coupling portions, in the second operating position of the first coupling portion, are configured for defining a locking condition in which said first and second coupling portions are stably engaged with each other to oppose the passage of the closure system from the closed condition to the open one, wherein said first coupling portion comprises:

at least one central body;

at least one tab emerging from the central body and which is, at least in the first operating position of the first coupling portion, at least partly facing the undercut portion of the second coupling portion, wherein said at least one tab, at least during the passage of the first coupling portion from the first to the second operating position, is configured for being folded with respect to the central body to allow the passage of the at least one tab itself and of at least one part of the central body through the through pocket, wherein said at least one tab, in the second operating position of the first coupling portion, is stably engaged with the undercut portion defining the locking condition, wherein at least one part of the first coupling portion defines a removable portion configured for being separated from the closure system during a first open condition of the container following the locking condition to provide evidence of a tampering of the container, wherein the closure system has a through seat delimited by a perimeter edge with a closed profile;

wherein the removable portion is engaged with at least one section of the perimeter edge of the through seat by way of the at least one weakening portion, and wherein said removable portion, at least in the first operating position, is arranged within said through seat.

2. The container according to claim 1, wherein the central body has a size smaller than a passage area of the through pocket of the second coupling portion, wherein the central body, in the first closed condition of the container and in the first operating position of the first coupling portion, faces the through pocket.

3. The container according to claim 1, wherein the at least one tab is integrally joined to the central body by means of a folding edge in which the undercut portion of the second coupling portion, during the passage of the first coupling portion from the first to the second operating position, intercepts the tab to allow the folding thereof, at the folding edge, with respect to the central body.

4. The container according to claim 1, wherein the tab, in the second operating position of the first coupling portion, defines a respective undercut portion of the first coupling portion itself facing the undercut portion of the second coupling portion.

5. The container according to claim 1, wherein the central body is extended along a development plane while the at least one tab is extended along a respective development plane, wherein the central body and said tab, at least in the first operating position, are parallel to each other, wherein, in the second operating position, the development plane of the at least one tab is tilted with respect to the respective development plane of the central body.

6. The container according to claim 1, wherein the at least one tab comprises a first and a second tab integrally joined to the central body and arranged one opposite the other with respect to the central body itself, said first and second tabs being configured for being folded with respect to the central body, during the passage of the first coupling portion from the first to the second operating position;

wherein the first and second tabs, in the second operating position of the first coupling portion, define a "C" or "U" shape whose concavity faces the internal volume and/or towards the closure system.

7. The container according to claim 1, wherein the second coupling portion comprises at least one locking tab emerging from the undercut portion, at least partly closing the through pocket;

wherein the locking tab is integrally joined to the undercut portion of the second coupling portion via at least one respective folding edge.

8. The container according to claim 7, wherein the at least one locking tab, during the passage of the first coupling portion from the first to the second operating position, is configured for being folded with respect to the undercut portion of the second coupling portion, at least partly in the internal volume of the support to allow the passage of at least part of the first coupling portion;

wherein the locking tab, at least in the locking condition, faces the portion of the central body of the first coupling portion arranged in the internal volume of the support.

9. The container according to claim 7, wherein the locking tab, at least in the locking condition, is interposed between the through pocket of the second coupling portion and the at least one part of the first coupling portion arranged in the internal volume of the support.

10. The container according to claim 1, wherein the first coupling portion is engaged with the closure system only by way of at least one weakened portion configured for being broken following an attempt to open the container placed in the locking condition.

11. The container according to claim 1, wherein the first coupling portion comprises a base body integrally joined to the central body by means of a respective folding edge, wherein the central body of the first coupling portion is foldable with respect to the base body around said folding edge to allow at least one part of the central body itself, during the passage from the first to the second operating position, to pass through the through pocket to be arranged at least partly in the internal volume of the support.

12. The container according to claim 11, wherein the first coupling portion, in the second operating position, is engaged with the closure system only by way of the base body, wherein the base body, in the second operating position, is engaged with the closure system only by way of said weakening portion;

wherein the base body, in the second operating position, is placed outside the internal volume of the container while the central body and the at least one tab are placed in the internal volume engaging with the second coupling portion; and wherein the removable portion is defined by the base body, by the central body and by the at least one tab of the first coupling portion.

13. The container according to claim 1, wherein the support comprises at least one intermediate flap emerging from at least one section of the outer edge and at least partly facing the base, wherein said at least one intermediate flap at least partly delimits a passage opening configured for placing in communication the internal volume with the external environment;

wherein the intermediate flap is configured for being at least partly superimposed on the abutment flap and being interposed, in the closed condition of the container, between a portion of the abutment flap and a portion of the closure system;

wherein the intermediate flap has a through opening delimited by a perimeter edge which, at least in the first closed condition and in the first open condition of the container, faces the through pocket of the second coupling portion;

wherein said through opening of the intermediate flap being configured for allowing the passage of the first coupling portion, during the passage of the latter from the first to the second operating position, to allow said first engagement portion to pass through the through pocket and engage the undercut portion of the second coupling portion.

14. The container according to claim 1, wherein the at least one lateral wall of the support has at least one air-vent opening configured for allowing, at least in the closed condition of the container, the fluid communication between the internal volume and the external environment to allow the air present in the internal volume to vent outside the container.

15. The container according to claim 1, comprising at least one separator which connects the abutment flap to the base of the support, said separator being extended into the internal volume of the support and being configured for dividing a central zone of the support adapted to receive the product from a peripheral zone of the support at which the abutment flap is present, wherein the abutment flap is extended lengthwise along the outer edge of the support, wherein the separator is extended lengthwise substantially for the entire length of the abutment flap to substantially define a channel;

wherein the separator is configured for dividing the internal volume of the support into a first and a second sub-chamber, wherein the first sub-chamber defines said at least one central zone of the support adapted to receive the product while the second sub-chamber is delimited by the channel and is arranged at a peripheral zone of the support, wherein the separator is arranged at least partially facing the air-vent opening.

* * * * *